US012648654B1

(12) United States Patent
Campbell et al.

(10) Patent No.: US 12,648,654 B1
(45) Date of Patent: Jun. 9, 2026

(54) MATTRESSES INCLUDING STACKED ELASTOMERIC LAYERS AND RELATED METHODS FOR SAME

(71) Applicant: Purple Innovation, LLC, Lehi, UT (US)

(72) Inventors: Jordan Isaac Campbell, Lehi, UT (US); Ross Olinski, Lehi, UT (US); James T. Grutta, Draper, UT (US); Jeff Hutchings, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 19/019,306

(22) Filed: Jan. 13, 2025

(51) Int. Cl.

| | |
|---|---|
| ***A47C 27/045*** | (2006.01) |
| ***A47C 23/00*** | (2006.01) |
| ***A47C 23/043*** | (2006.01) |
| ***A47C 27/00*** | (2006.01) |
| ***A47C 27/05*** | (2006.01) |

(Continued)

(52) U.S. Cl.
CPC ..... *A47C 27/045* (2013.01); *A47C 23/002* (2013.01); *A47C 23/0431* (2013.01); *A47C 27/001* (2013.01); *A47C 27/056* (2013.01); *A47C 27/062* (2013.01); *A47C 27/15* (2013.01)

(58) Field of Classification Search
CPC ... A47C 27/045; A47C 27/001; A47C 27/056; A47C 27/062; A47C 27/15; A47C 23/002; A47C 23/0431
See application file for complete search history.

(56) References Cited

U.S. PATENT DOCUMENTS 3,043,731 A * 7/1962 Hill ..... B29C 44/56 428/137
4,369,284 A 1/1983 Chen
5,749,111 A 5/1998 Pearce
(Continued)

FOREIGN PATENT DOCUMENTS

WO WO-2019022987 A1 * 1/2019 ..... A47C 27/0453

OTHER PUBLICATIONS

U.S. Appl. No. 18/408,199, filed Jan. 9, 2024, DORIUS et al.
(Continued)

*Primary Examiner* — Matthew Troutman
*Assistant Examiner* — Alison N Labarge
(74) *Attorney, Agent, or Firm* — Foley & Lardner LLP

(57) ABSTRACT

A cushion assembly includes a plurality of layers, including a plurality of buckling layers, arranged in a stack. The plurality of buckling layers includes a first buckling layer, and a second buckling layer disposed over the first buckling layer. The plurality of buckling layers includes a plurality of buckling points such that the plurality of buckling layers buckle under different loading conditions. For example, the first buckling layer is configured with a first buckling point and the second buckling layer is configured with a second buckling point different than the first buckling point. The cushion assembly may further include a first intermediate layer disposed over a coil layer, the plurality of buckling layers disposed over the first intermediate layer, and a microgrid layer disposed over the second intermediate layer. The intermediate layers include a foam, and the buckling layers and the microgrid layer include an elastomeric cushioning element.

20 Claims, 10 Drawing Sheets

(51) Int. Cl.
*A47C 27/06* (2006.01)
*A47C 27/15* (2006.01)

(56) References Cited

U.S. PATENT DOCUMENTS

| | | | | |
|---|---|---|---|---|
| 5,994,450 | A | 11/1999 | Pearce | |
| 6,026,527 | A | 2/2000 | Pearce | |
| 6,797,765 | B2 | 9/2004 | Pearce | |
| 7,060,213 | B2 | 6/2006 | Pearce | |
| 7,666,341 | B2 | 2/2010 | Pearce | |
| 7,964,664 | B2 | 6/2011 | Pearce | |
| 8,424,137 | B1 * | 4/2013 | Pearce | A47C 27/085 5/655.5 |
| 8,434,748 | B1 | 5/2013 | Pearce et al. | |
| 8,628,067 | B2 | 1/2014 | Pearce et al. | |
| 8,919,750 | B2 | 12/2014 | Pearce et al. | |
| 8,932,692 | B2 | 1/2015 | Pearce | |
| 2010/0058541 | A1 * | 3/2010 | Kemper | A47C 27/15 156/182 |
| 2014/0259426 | A1 * | 9/2014 | Pearce | A47C 27/085 5/653 |
| 2017/0251825 | A1 | 9/2017 | Pearce | |
| 2018/0078062 | A1 * | 3/2018 | Pearce | A47G 9/1027 |
| 2022/0110456 | A1 * | 4/2022 | Micklos | B68G 7/00 |
| 2024/0245227 | A1 | 7/2024 | Pettit et al. | |
| 2024/0251958 | A1 | 8/2024 | Grutta et al. | |

OTHER PUBLICATIONS

U.S. Appl. No. 18/528,273, filed Dec. 4, 2023, MOSTAFA et al..
U.S. Appl. No. 18/769,123, filed Jul. 10, 2024, ACHARYA et al..
U.S. Appl. No. 18/957,109, filed Nov. 22, 2024, GRUTTA et al..

* cited by examiner

MATTRESSES INCLUDING STACKED ELASTOMERIC LAYERS AND RELATED METHODS FOR SAME

TECHNICAL FIELD

This disclosure relates generally to cushioning elements such as mattresses including multiple layers of elastomeric materials, and to methods of making such mattresses.

BACKGROUND

Cushioning materials have a variety of uses, such as for mattresses, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under load, such as polyethylene or polyurethane foams (e.g., convoluted foam), vinyl, rubber, springs, natural or synthetic fibers, fluid filled flexible containers, etc. Different cushioning materials may have different responses to a given pressure, and some materials may be well suited to different applications. Cushioning materials may be used in combination with one another to achieve selected properties.

SUMMARY

One embodiment invention relates to a cushion assembly including a first intermediate layer, a first buckling layer, second buckling layer disposed over an upper surface of the first buckling layer, and a second intermediate layer disposed over an upper surface of the second buckling layer. The plurality of buckling layers is arranged in a stack and includes a first buckling layer.

Another embodiment of the invention relates to a cushion assembly including a coil layer, a first intermediate layer disposed over an upper surface of the coil layer, a first buckling layer disposed over an upper surface of the first intermediate layer, a second intermediate layer disposed over an upper surface of the first intermediate layer, and a microgrid layer disposed over an upper surface of the second intermediate layer. The coil player includes a plurality of coils. The microgrid layer may include a plurality of interconnected walls of gel.

Still another embodiment of the invention relates to a cushion assembly including a coil, a first intermediate foam layer disposed over an upper surface of the coil layer, a plurality of buckling elastomeric layers, arranged in a stack, a second intermediate foam layer disposed over an upper surface of the top buckling elastomeric layer of the plurality of buckling elastomeric layers, and a microgrid gel layer disposed over an upper surface of the second intermediate foam layer. The plurality of buckling layer includes a first buckling elastomeric layer, a second buckling elastomeric layer disposed over an upper surface of the first buckling elastomeric layer, and a scrim layer configured with a surface to adhere the first buckling elastomeric layer to the second buckling elastomeric layer.

Numerous specific details are provided to impart a thorough understanding of embodiments of the subject matter of the present disclosure. The described features of the subject matter of the present disclosure may be combined in any suitable manner in one or more embodiments and/or implementations. In this regard, one or more features of an aspect of the invention may be combined with one or more features of a different aspect of the invention. Moreover, additional features may be recognized in certain embodiments and/or implementations that may not be present in all embodiments or implementations.

DETAILED DESCRIPTION

Figure 1:
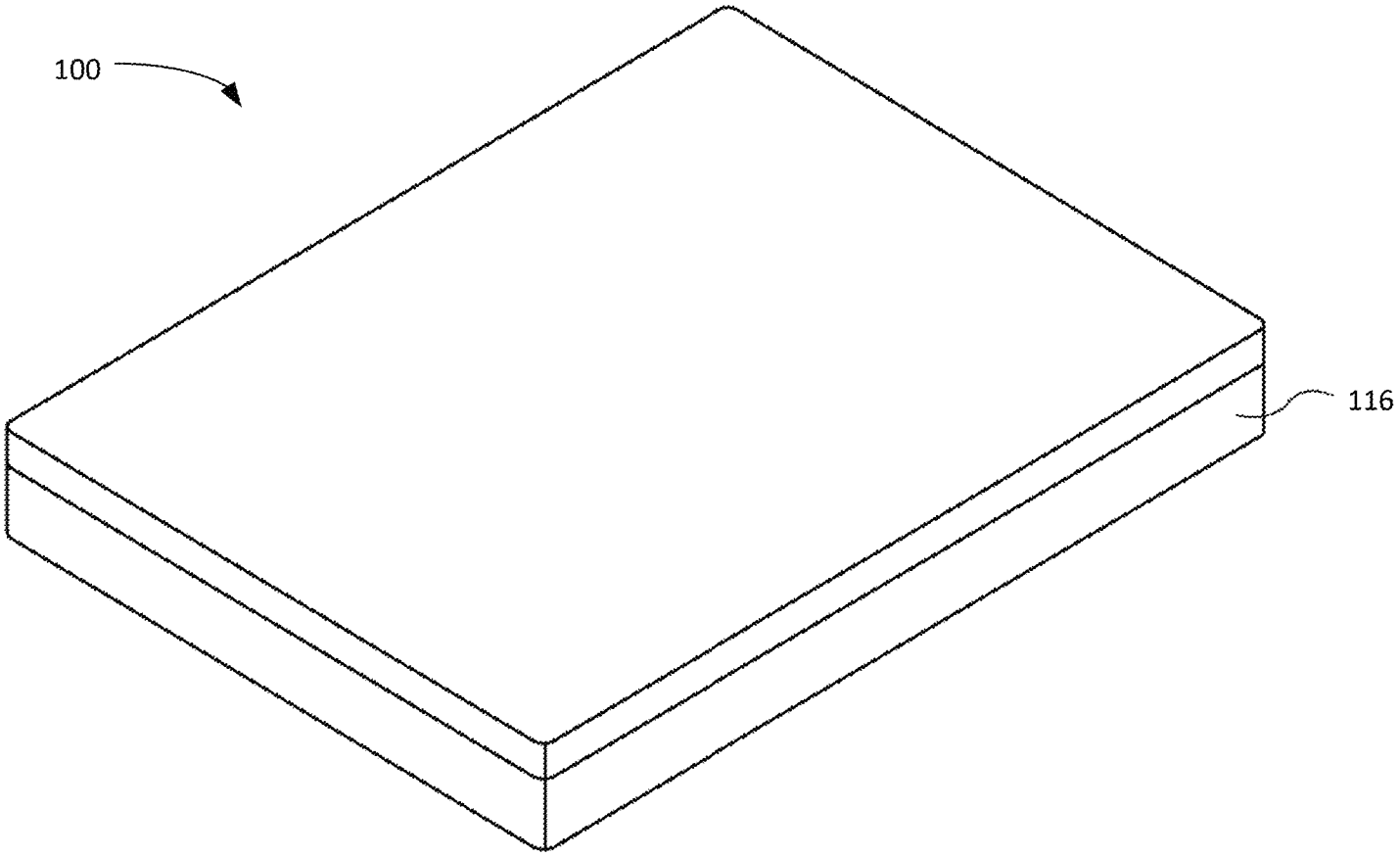
FIG. 1 is a perspective view of a cushion assembly, according to an exemplary embodiment.

Referring generally to the FIGURES, cushion assemblies such as mattresses may include pocketed coils in combination with layers of foam, elastomer gels, etc. in order to achieve desired results in the cushioning materials. The elastomeric gel may include interconnected walls that define arrays of buckling columns. Buckling typically occurs when a buckling column is subjected to a set amount of force, or weight. Specifically, a buckling column buckles when a pressure applied to a surface of the elastomeric gel, in a direction perpendicular to the surface, exceeds a threshold pressure level. The threshold pressure level is referred to herein as the buckling point. Buckling reduces interface pressures between a subject and the cushion. The amount of force or weight sufficient to buckle a buckling column depends on a number of factors such as the geometry of the bucking column and the stiffness of the elastomer gel, amongst other factors. After buckling, the column may thereafter continue to apply pressure to a portion of the subject supported by the buckling column. That pressure may be uncomfortable to the user and potentially cause pressure damage to the user. The force, or weight, required to buckle a buckling column may also be too great, such that a given user's body may be insufficient to buckle the buckling column, or the force, or weight, may be too small, such that a given user's body buckles the column without the buckling column providing sufficient support to the user.

As disclosed herein a cushion assembly may include a plurality of buckling layers to provide additional buckling points to a user and reduce the pressure applied from a buckling column to a user. A cushion assembly may thus include a coil layer, the coil layer including a plurality of pocketed coils, a first intermediate layer disposed over the coil layer, a plurality of buckling layers, arranged in a stack and disposed over the first intermediate layer, a second intermediate layer disposed over an upper surface of a topmost buckling layer of the plurality of buckling layers. In some embodiments, the plurality of buckling layers includes a first buckling layer, and a second buckling layer disposed over the first buckling layer. In such embodiments, the second intermediate layer is disposed over the second buckling layer. In some embodiments, a third buckling layer is disposed over the second buckling layer and, thus, the second intermediate layer is disposed over the third buckling layer. Each buckling layer may include or be an elastomeric cushioning element. In some embodiments, the elastomeric cushioning elements include buckling columns which buckle under the same weight, or force (i.e., the same buckling points), and, in other embodiments, the elastomeric cushioning elements include buckling columns with different buckling points. In some embodiments, the first intermediate layer includes a foam that is different than the foam of the second intermediate layer. In use, the plurality of buckling layers may compensate for different levels of force, or weight, which may be applied to the cushioning element during use. For example, the pressure from a user on the user's back resting on the cushion assembly may be sufficient to couple a first buckling layer of the plurality of buckling layers but not a second buckling layer. The plurality of buckling layers thus works together to provide cushioning—due to the first buckling layer buckling—but to also provide support due to the second buckling layer remaining unbuckled. The plurality of buckling layers thereafter provides additional cushioning, if necessary, by the second buckling layer buckling.

As a specific example, the cushion assembly may be a mattress. In use and when a user transitions from the user's back to the user's side, the pressure may increase to be sufficient to buckle the first buckling layer and the second buckling layer. The second buckling layer allows the cushion assembly to compensate for the increased pressure by providing further cushioning in a second buckling action, thereby improving the ability of the cushion assembly to provide enhanced comfort and support in a variety of sleeping or resting positions. The same benefits may apply to users of different weights, who may each be cushioned yet supported by the plurality of buckling columns working together.

Technically and beneficially, the cushion assemblies of the present disclosure may provide a variety of benefits and advantages. The cushion assemblies described herein include a plurality of buckling layers that are stacked, wherein each buckling layer has a discrete buckling point, resulting in cushion assemblies with multiple sets of buckling stages and non-buckling stages depending on the applied pressure. These stages, as described above, allow a single mattress to support a wider range of users and sleeping positions, as each user and/or sleeping position will cause the cushion assembly to transition through one or more of the buckling and non-buckling stages as necessary based on the pressure applied. Additionally, the plurality of buckling layers further increases the depth of deformation provided to a user while still supporting a user while lying on the cushion assembly. These and other features and benefits are described more fully herein below.

Figure 2:
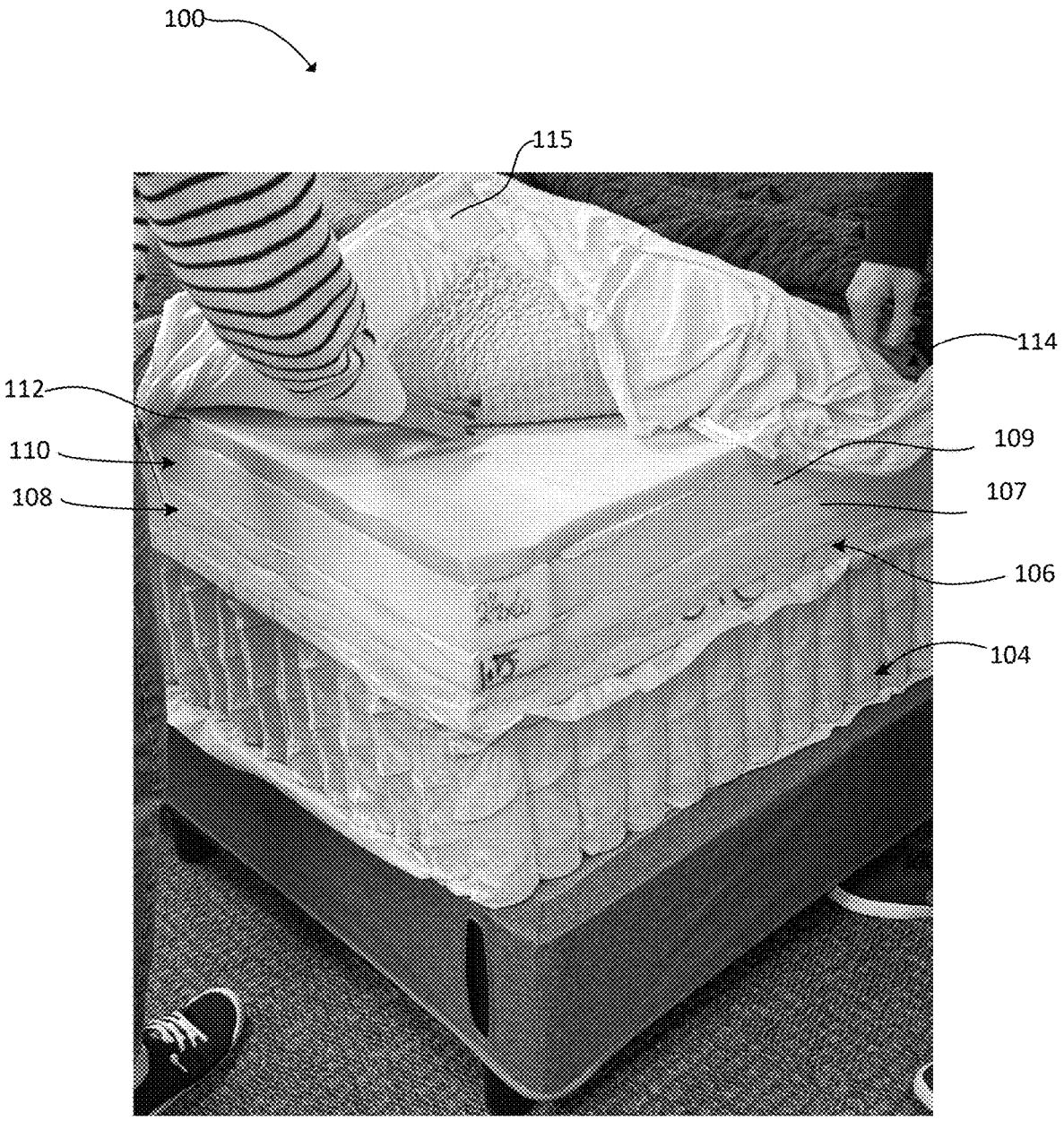
FIG. 2 is a cutaway perspective view of the cushion assembly of FIG. 1, according to an exemplary embodiment.
Figure 3:
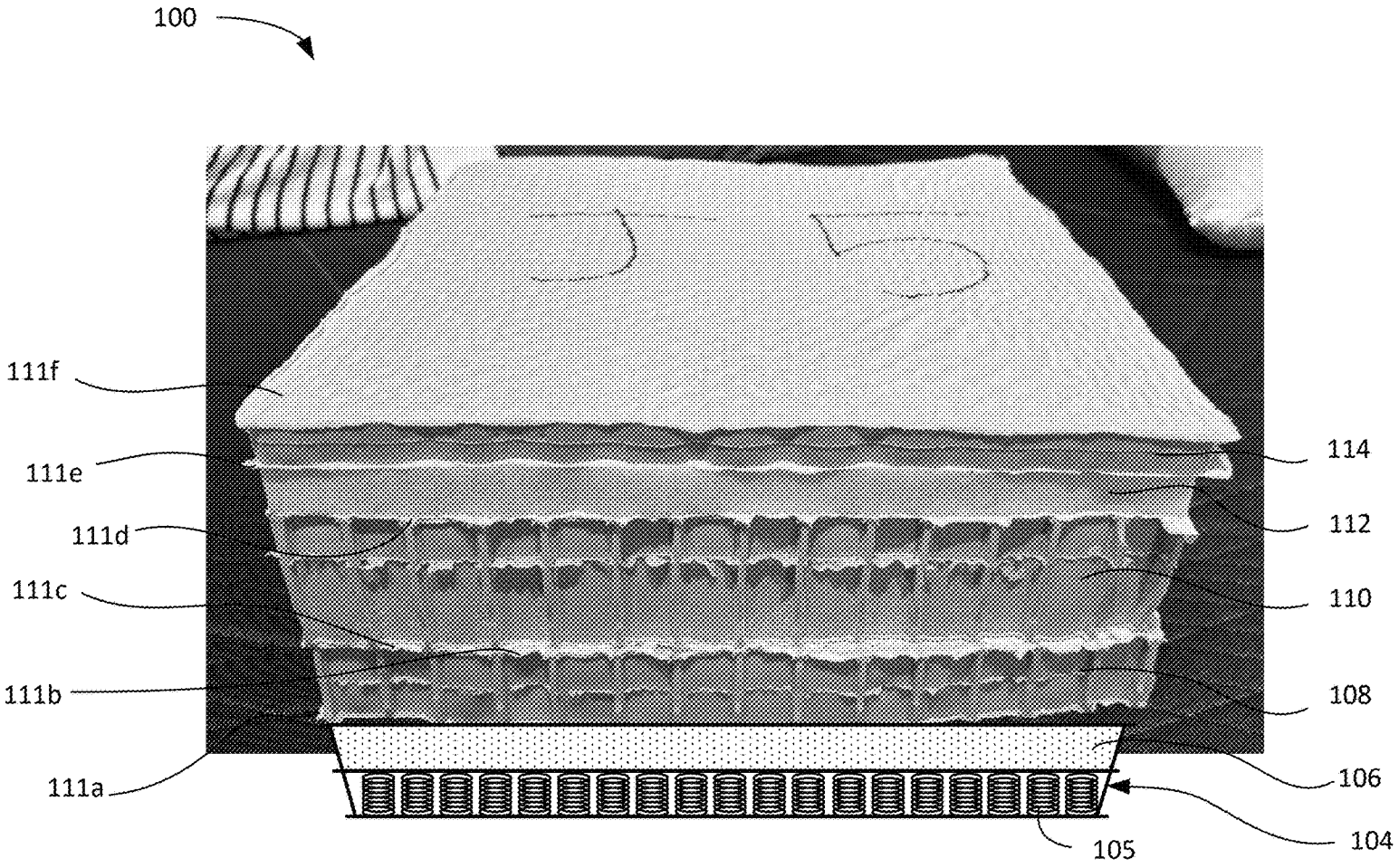
FIG. 3 is a perspective cross-sectional view of an inner cushion of the mattress assembly shown in FIG. 2, according to an exemplary embodiment.

Referring to FIGS. 1-3, a cushion assembly is shown, according to an example embodiment. In FIG. 1 a perspective view of a cushion assembly 100 is shown, according to an exemplary embodiment. The cushion assembly 100 includes an outer covering 116. FIG. 2 shows a cutaway perspective view of the cushion assembly 100 of FIG. 1. FIG. 3 provides a view of an inner assembly of the cushion assembly 100 in FIG. 2. In FIGS. 2 and 3, various portions of the cushion assembly 100 are removed to provide a cutaway view and to better show internal components of the cushion assembly 100.

Referring still to FIGS. 1-3, the cushion assembly 100 may include a coil layer 104, one or more intermediate layers (shown as intermediate layers 112 and 106) and one or more elastomeric cushioning elements (shown as buckling layers 108, 110, and microgrid layer 114) in an at least partially superimposed arrangement with each other, and an outer covering 116. In some embodiments, an optional stabilization layer 111 is disposed in between the layers or cushioning elements of the cushion assembly 100. In some embodiments, the one or more intermediate layers may include a first intermediate layer 106 and a second intermediate layer 112. In some embodiments, the one or more elastomeric cushioning elements may include or be a first buckling layer 108 (section, portion, etc.), a second buckling layer 110 (section, portion, etc.), and a third buckling layer referred to herein as a microgrid layer 114 (section, portion, etc.).

Each of the elastomeric cushioning members (e.g., first buckling layer 108, second buckling layer 110, microgrid layer 114) may include an edge portion 109 extending around an outer lateral edge of the elastomeric cushioning member to provide additional support and structure to the edge of the elastomeric cushioning element. The edge portion 109 may extend laterally within the same plane as the elastomeric cushioning member, with upper and lower surfaces parallel with the generally planar upper and lower surfaces of the elastomeric cushioning member, thereby extending a width and a length of the elastomeric cushioning layer. The edge portion 109 may be melted, chemically bonded, scrimmed, or otherwise affixed to the elastomeric cushion element. The edge portion 109 may be made of a material with a stiffness greater than the stiffness of the elastomeric cushioning element, such as a foam, or the edge portion 109 may be made of the same elastomeric cushioning material. As shown in FIG. 2, the first buckling layer 108 includes an edge portion 107, the second buckling layer 110 includes a second edge portion 109, and the microgrid layer 114 includes a third edge portion 115.

The coil layer 104 may have generally planar top and bottom surfaces. The first intermediate layer 106 may be disposed over the coil layer 104. The first buckling layer 108 may be disposed over the first intermediate layer 106. A first edge portion 107 may extend around an outer lateral edge of the first buckling layer 108. In some embodiments, the second buckling layer 110 may be disposed over the first buckling layer 108 and the first edge portion 107. A second edge portion 109 may extend around an outer lateral edge of the second buckling layer 110. The second intermediate layer 112 may be disposed over the second buckling layer 110 and second edge portion 109, if any, and over the first buckling layer 108 and the first edge portion 107. The microgrid layer 114 is disposed over the second intermediate layer 112. A third edge portion 115 may extend around an outer lateral edge of the microgrid layer 114.

The outer covering 116 may extend from the bottom surface of the coil layer 114, if any, and may at least substantially encase or enclose, at least substantially or, in some embodiments, completely, the coil layer 104, the one or more intermediate layers, the one or more elastomeric cushioning elements, and the one or more edge portions. In some embodiments, the outer cover 116 is a single unitary or uni-body fabric. In other embodiments, the outer cover 116 is an assembly of materials adhered together (e.g., stitched, glued, etc.) that collectively form the outer cover to surround or encapsulate the cushion assembly. The outer covering 116 may comprise a stretchable material that may be secured to the microgrid layer 114. Such a stretchable material is described in U.S. Patent Application Publication No. 2017/0251825, published Sep. 7, 2017, the entire disclosure of which is hereby incorporated herein. In some embodiments, one or more of the edge portions include a foam (e.g., polyurethane, memory, latex, etc.).

In some embodiments, the cushion assembly 100 includes one or more stabilization layers 111. A stabilization layer 111 may be disposed on one or more of the elastomeric cushioning elements (e.g., first buckling layer 108, second buckling layer 110, microgrid layer 114). The stabilization layers 111 may extend substantially or completely over the one or more elastomeric cushioning elements, including, in some embodiments, an edge portion thereof. For example, a stabilization layer 111 may extend over the generally planar upper surface of the first buckling layer 108 and the generally planar upper surface of the first edge portion 107 that is parallel with the upper surface of the first buckling layer 108. In other embodiments, the stabilization layer 111 extends over only the elastomeric gel portion of the first buckling layer 108 but terminates prior to the first edge portion 107. In such embodiments, the stabilization layer 111 has a width and a length less than the width and the length of the stabilization layer 111 which extends across the first edge portion 107.

With reference to FIG. 3, the first buckling layer 108 includes an upper top surface proximate the second buckling layer 110 and a lower bottom surface proximate the first intermediate layer 106. Coupled to each of the top surface and the bottom surface may a stabilization layer 111, such that a first stabilization layer 111*a* is disposed between the first intermediate layer 106 and the first buckling layer 108 and a second stabilization layer 111*b* is disposed between the first buckling layer 108 and the second buckling layer 110. The stabilization layers 111*a* and 111*b* may completely cover the upper and lower surfaces of the first buckling layer 108, in some embodiments. In other embodiments, the stabilization layers 111*a* and 111*b* may only partially cover the upper and lower surfaces of the first buckling layer 108. Still in other embodiments, one or both of the stabilization layers 111*a* and 111*b* may be excluded. In some embodiments, the stabilization layers 111*a* and/or 111*b* extend across the elastomeric gel of the first buckling layer 108 and the first edge portion 107. In other embodiments, the stabilization layers 111*a* and/or 111*b* do not extend across the first edge portion 107.

Still referring to FIG. 3, the second buckling layer 110 includes an upper top surface proximate the second intermediate layer 112 and a lower bottom surface proximate the first buckling layer 108. Coupled to each of the top surface and the bottom surface may a stabilization layer 111, such that a third stabilization layer 111*c* is disposed between the first buckling layer 108 and the second buckling layer 110 and a fourth stabilization layer 111*d* is disposed between the second buckling layer 110 and the second buckling layer 110. The third stabilization layer 111*c* may be disposed adjacent the second stabilization layer 111*b*, in some embodiments. In other embodiments, the second stabilization layer 111*b* is excluded and the third stabilization layer 111*c* is directly adjacent the first buckling layer 108. The stabilization layers 111*c* and 111*d* may completely cover the upper and lower surfaces of the second buckling layer 110, in some embodiments. In other embodiments, the stabilization layers 111*c* and 111*d* may only partially cover the upper and lower surfaces of the second buckling layer 110. Still in other embodiments, one or both of the stabilization layers 111*c* and 111*d* may be excluded. In some embodiments, the stabilization layers 111*c* and/or 111*d* extend across the elastomeric gel of the second buckling layer 110 and the second edge portion 109. In other embodiments, the stabilization layers 111*c* and/or 111*d* do not extend across the second edge portion 109.

The microgrid layer 114 includes an upper top surface proximate cover 116 and a lower bottom surface proximate the second intermediate layer 112. Coupled to each of the top surface and the bottom surface may be a stabilization layer 111, such that a fifth stabilization layer 111*e* is disposed between the second intermediate layer 112 and the microgrid layer 114 and a fourth intermediate layer 111*f* is disposed between the microgrid layer 114 and the cover 116. The fifth stabilization layer 111*e* may be disposed adjacent the fourth intermediate layer 111*d*, in some embodiments. In other embodiments, the fourth stabilization layer 111*d* is excluded and the fifth stabilization layer 111*e* is directly adjacent the second intermediate layer 112. The intermediate layers 111*e* and 111*f* may completely cover the upper and lower surfaces of the microgrid layer 114, in some embodiments. In other embodiments, the stabilization layers 111*e* and 111*f* may only partially cover the upper and lower surfaces of the microgrid layer 114. Still in other embodiments, one or both of the stabilization layers 111*e* and 111*f* may be excluded. In some embodiments, the stabilization layers 111*e* and/or 111*f* extend across the elastomeric gel of the microgrid layer 114 and the third edge portion 115. In other embodiments, the stabilization layers 111*e* and/or 111*f* do not extend across the third edge portion 115. In other embodiments, the microgrid layer 1144 may be excluded.

The stabilization layer 111 may include or be a relatively thin material (e.g., a cotton spandex blend "scrim") and may be used to provide a surface for adhering (e.g., gluing, fusing, etc.) the elastomeric cushioning element to adjacent layers, such as an upper surface of another elastomeric cushioning element, an upper surface of the coil layer 104, and/or an upper surface of another intermediate layer. In some embodiments, the material of the stabilization layer 111 may include a scrim fabric (e.g., a woven or non-woven fabric material) and portions of an elastomeric cushioning element may seep through (e.g., be melt fused into, bleed through, push through, leak through, pass through, etc.) the scrim fabric of the stabilization layer 111. In embodiments where an elastomeric cushioning element includes a gel material, portions of the gel material of the elastomeric cushioning element that extend through the scrim fabric of the stabilization layer 111 may define non-slip features or reduced slip features that create a non-slip surface or reduced slip surface on a surface of the stabilization layer 111 (e.g., a lower surface of the stabilization layer 111 that would contact the upper surface of the coil layer 104 or the upper surface of an intermediate layer). Where disposed, the non-slip surface or reduced slip surface may help the elastomeric cushioning element stay in place, such as relative to the coil layer 104, an intermediate layer, and other components of the cushion assembly 100. In such embodiments, the stabilization layer 111 may include part of the elastomeric cushioning element.

In some embodiments, a stabilization layer 111 may be provided on a top surface of the coil layer 104 and the bottom surface of the first intermediate layer 106. In some embodiments, a stabilization layer 111 may be provided on a bottom surface of the first buckling layer 108 and include part of the first buckling layer 108; thus, the first buckling layer 108 may be placed on and contact an upper surface of the first intermediate layer 106. Optionally, another stabilization layer 111 may be provided over the first buckling layer 108; thus, the first buckling layer 108 may contact a bottom surface of the second buckling layer 110. Another stabilization layer 111 may be provided over the second buckling layer 110 and in contact with the bottom surface of the second intermediate layer 112. In some embodiments, a stabilization layer 111 is provided on the upper or bottom surfaces of the microgrid layer 114.

Referring to FIGS. 2-3, the coil layer 104 may include a plurality of coils 105. Each of the coils 105 may be formed from a metal (e.g., steel), plastic, another material, and/or a combination of materials. In the example shown, each coil 105 of the plurality of coils 105 may be encased in at least one respective casing (e.g., polypropylene socks or bags). Each casing of each coil 105 of the plurality of coils 105 may be individual and discrete. For example, each casing may form a pocket for a respective coil 105. In some embodiments, each coil 105 may include a relatively thin-gauge, barrel-shaped (e.g., helical-shaped), knotless coil. Furthermore, in one or more embodiments, each coil 105 may be encased in multiple casings. For instance, each coil 105 may be double bagged or triple bagged. In some embodiments, the casings may include a polypropylene material. The casings may include a two-ply polypropylene non-woven material. In some embodiments, each ply of the casings may have a thickness within a range of about 0.10 mm and about 0.40 mm. As an example, each ply of the casings may have a thickness within a range of about 0.15 mm and about 0.30 mm. However, any suitable material may be used. Additionally, each coil 105 of the plurality of coils 105 may extend longitudinally in a direction at least substantially orthogonal (i.e., normal) to an upper surface of the coil layer 114. Furthermore, the plurality of coils 105 may be spaced next to each other in an array (e.g., rows and columns or a grid pattern) to form the coil layer 104. In some embodiments, a pocketed coil may include a coil topper made of a gel or foam. Each coil may include a separate and distinct coil topper, according to the teachings of U.S. Publication No. 2024/0251958, the entire disclosure of which are incorporated by reference herein. The coils 105 may be individually placed, in groups or subassemblies, or as a preassembled unit. Alternatively, adjacent coils 105 may be connected (i.e., joined) or groups of coils may be packaged together. In some embodiments, a coil topper layer may extend across a plurality of coils 105, up to and including the extending substantially across the coil layer 104.

The first intermediate layer 106 may include a cushioning element (e.g., foam, gel, etc.). In some embodiments, the first intermediate layer 106 may extend over or substantially over the coil layer 104, such that when disposed and from a top planar view, the coil layer 104 is not visible or only minimally visible (e.g., at the peripheral edges of the layer 104). In some embodiments, the first intermediate layer 106 may include one or more of a pneumatic foam, viscoelastic foam, memory polyurethane foam, a latex foamed rubber, or any other suitable foam. In some embodiments, the first intermediate layer 106 has an indentation load deflection ("ILD") between 12-46 and a thickness between 0.5-3.0 inches (about 1.3-7.6 cm).

The second intermediate layer 112 may include a cushioning element (e.g., foam, gel, etc.). In some embodiments, the second intermediate layer 112 may extend over or substantially over an elastomeric cushioning element (e.g., first buckling layer 108, second buckling layer 110, etc.), such that when disposed and from a top planar view, the buckling layer that the intermediate layer 112 is disposed over or on top of is not visible or only minimally visible (e.g., at the peripheral edges of the intermediate layer 112). In some embodiments, the second intermediate layer 112 may include one or more of a pneumatic foam, a viscoelastic foam, a memory polyurethane foam, a latex foamed rubber, or any other suitable foam. In some embodiments, the second intermediate layer 112 has an ILD between 12-46 and a thickness between 0.5-3.0 inches (about 1.3-7.6 cm).

In some embodiments, the first intermediate layer 106 and the second intermediate layer 112 are made of the same cushioning element or cushioning material. In some other embodiments, the first intermediate layer 106 and the second intermediate layer 112 are made from different cushioning elements or cushioning materials. For example, the first intermediate layer 106 may include a relatively stiffer viscoelastic foam (i.e., higher ILD value) than the second intermediate layer 112, while the second intermediate layer 112 may include a relatively softer pneumatic foam or vice versa. Alternatively, the first intermediate layer 106 may include a plurality of intermediate cushioning elements, each of which may be placed over an individual coil or over a group of coils (e.g., over a group of two, three, four, five, six, or seven coils) of the coil layer 104, depending upon the size and shape of the intermediate cushioning element. The plurality of cushioning elements placed over each coil in the coil layer 104 are described in greater detail in U.S. patent application Ser. No. 18/102,671, filed Jan. 27, 2023, the entire disclosure of which is incorporated by reference herein.

The cushion assembly includes one or more elastomeric cushioning elements configured in at least one or more layers in the cushion assembly 100 (e.g., first buckling layer 108, second buckling layer 110, microgrid layer 114, or other additional layer made of elastomeric material). An elastomeric cushioning element may include a molded elastomeric cushioning element. For example, an entire layer of the elastomeric cushioning element may be formed via a single molding process. Alternatively, a layer of an elastomeric cushioning element may include a plurality of individual sections, which may be separately formed, separated from each other, etc., and arranged in a layer. In some embodiments, a plurality of individual sections may be melted, chemically bonded, scrimmed, or otherwise affixed to each other to form a single layer. The elastomeric cushioning element may have generally planar top and bottom surfaces. In other embodiments, the surfaces may be non-planar (e.g., not substantially flat). Each elastomeric cushioning element may have a height or thickness between 0.5-4 inches (about 1.3-10.2 cm) (e.g., one inch (about 2.5 cm), one and three quarter inches (about 4.5 cm), two inches (about 5.1 cm), two and a half inches (about 6.35 cm), three inches (about 7.6 cm), three and a half inches (about 8.9 cm), four inches (about 10.2 cm), etc.).

The elastomeric cushioning element may be formed of an elastomeric material. Elastomeric materials are described in, for example, U.S. Pat. No. 5,994,450, titled "Gelatinous Elastomer and Methods of Making and Using the Same and Articles Made Therefrom," issued Nov. 30, 1999 (hereinafter "the '450 patent"); U.S. Pat. No. 7,964,664, titled "Gel with Wide Distribution of MW in Mid Block" issued Jun. 21, 2011; U.S. Pat. No. 4,369,284, titled "Thermoplastic Elastomer Gelatinous Compositions" issued Jan. 18, 1983; U.S. Pat. No. 8,919,750, titled "Cushioning Elements Comprising Buckling Walls and Methods of Forming Such Cushioning Elements," issued Dec. 30, 2014 (hereinafter "the '750 patent"); the disclosures of each of which are incorporated herein in their entirety by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, TX, under the trade name SEPTON® 4055, and from Kraton Polymers, LLC, of Houston, TX, under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The elastomeric material may include elastomeric polymers other than styrene-based copolymers, such as non styrenic elastomeric polymers that are thermoplastic in nature or that can be solvated by plasticizers or that are multi component thermoset elastomers.

The elastomeric material may include one or more plasticizers, such as hydrocarbon fluids. For example, elastomeric materials may include aromatic free food grade white paraffinic mineral oils, such as those sold by Sonneborn, Inc., of Mahwah, NJ, under the trade names BLANDOL® and CARNATION®.

In some embodiments, the elastomeric material may have a plasticizer to polymer ratio from about 0.1:1 to about 50:1 by weight. For example, elastomeric materials may have plasticizer to polymer ratios from about 1:1 to about 30:1 by weight, or even from about 1.5:1 to about 10:1 by weight. In further embodiments, elastomeric materials may have plasticizer to polymer ratios of about 4:1 by weight.

The elastomeric material may have one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer. As another example, metal particles (e.g., aluminum, copper, etc.) may increase the thermal conductivity of the resulting elastomeric material because such particles may have greater thermal conductivity than the plasticizer or polymer. Microspheres filled with wax or another phase change material (i.e., a material formulated to undergo a phase change near a temperature at which a cushioning element may be used) may provide temperature stability at or near the phase change temperature of the wax or other phase change material within the microspheres (i.e., due to the heat of fusion of the phase change). The phase change material may have a melting point from about 20° C. to about 45° C.

The elastomeric material may also include antioxidants. Antioxidants may reduce the effects of thermal degradation during processing or may improve long term stability. Antioxidants include, for example, pentaerythritol tetrakis(3 (3,5 di tert butyl 4 hydroxyphenyl) propionate), commercially available as IRGANOX® 1010, from BASF Corp., of Iselin, NJ or as EVERNOX® 10, from Everspring Corp. USA, of Los Angeles, CA; octadecyl 3 (3,5 di tert butyl 4 hydroxyphenyl) propionate, commercially available as IRGANOX® 1076, from BASF Corp. or as EVERNOX® 76, from Everspring Chemical; and tris (2,4 di tert butylphenyl) phosphite, commercially available as IRGAFOS® 168, from BASF Corp. or as EVERFOS® 168, from Everspring Chemical. One or more antioxidants may be combined in a single formulation of elastomeric material. The use of antioxidants in mixtures of plasticizers and polymers is described in columns 25 and 26 of the '450 patent. The elastomeric material may include up to about 5 wt % antioxidants. For instance, the elastomeric material may include from about 0.10 wt % to about 1.0 wt % antioxidants.

In some embodiments, the elastomeric material may include a resin. The resin may be selected to modify the elastomeric material to slow a rebound of an elastomeric cushioning element after deformation. The resin, if present, may include a hydrogenated pure monomer hydrocarbon resin, such as those commercially available from Eastman Chemical Company, of Kingsport, TN, under the trade name REGALREZ®. The resin, if present, may function as a tackifier, increasing the stickiness of a surface of the elastomeric material.

In some embodiments, the elastomeric material may include a pigment or a combination of pigments. Pigments may be aesthetic and/or functional. That is, pigments may provide the elastomeric cushioning element with an appearance appealing to consumers (e.g., a purple color). In addition, an elastomeric cushioning element having a dark color may absorb radiation differently than an elastomeric cushioning element having a light color.

The elastomeric material may include a material that may substantially return to its original shape after deformation and that may be elastically stretched. The elastomeric material may be rubbery in feel but may deform to the shape of an object applying a deforming pressure better than conventional rubber materials and may have a durometer hardness lower than conventional rubber materials. For example, the elastomeric material may have a hardness on the Shore A scale of less than about 50, from about 0.1 to about 50, or less than about 5.

The elastomeric material may include any type of gelatinous elastomer. For example, the elastomeric material may include a melt blend of one part by weight of a styrene ethylene ethylene propylene styrene (SEEPS) elastomeric triblock copolymer (e.g., SEPTON® 4055) with four parts by weight of a 70 weight straight cut white paraffinic mineral oil (e.g., CARNATION® white mineral oil) and, optionally, pigments, antioxidants, and/or other additives.

In some embodiments, one or more elastomeric cushioning elements configured in at least one or more layers may be disposed in between the upper surface of the first intermediate layer 106 and the bottom surface of the second intermediate layer 112. The at least one or more layers disposed in between include a first buckling layer 108 and, in some embodiments, a second buckling layer 110 comprising buckling walls or columns. The first buckling layer 108 and second buckling layer 110 may comprise the same plasticizer to polymer ratios; however, it is contemplated that each layer may have differing plasticizer to polymer ratios.

Figure 4:
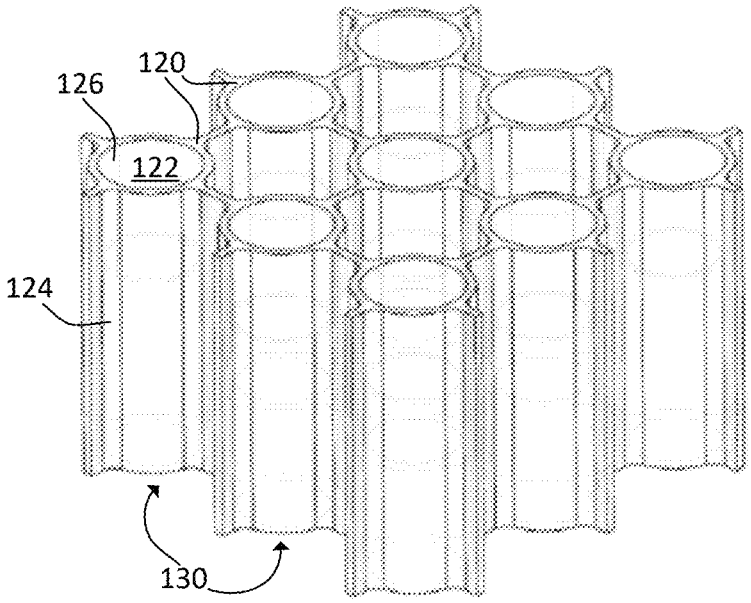
FIG. 4 is a perspective view of a portion of a buckling layer with interconnected walls that define circular or substantially circular buckling columns, according to an exemplary embodiment.
Figure 5:
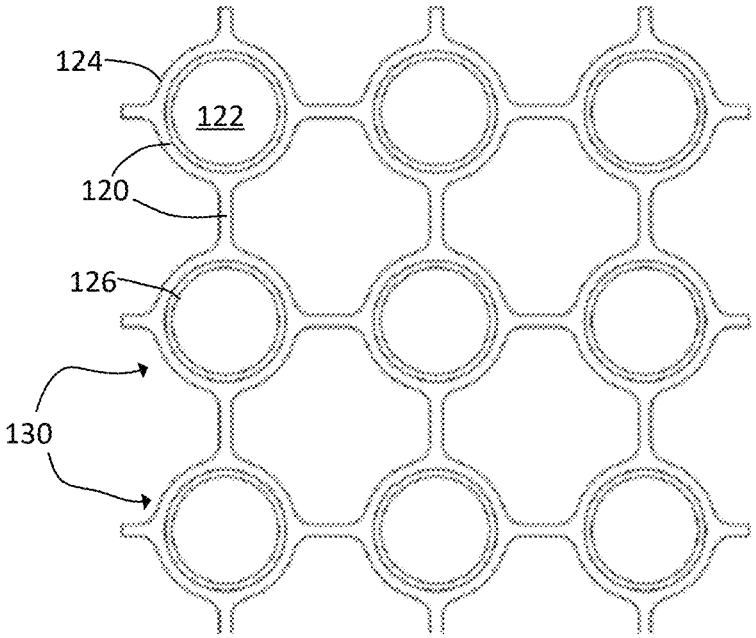
FIG. 5 is a top view of the portion of the buckling layer shown in FIG. 4, according to an exemplary embodiment.

With the above in mind, referring now to FIGS. 4-5, a perspective and top view of a portion of a buckling layer, 108 or 110, with interconnected walls 120 that define buckling columns 130 are shown, according to an exemplary embodiment. In some embodiments, the cushioning element with interconnected walls 120 that define buckling columns 130 form a layer of elastomeric material. Each interconnected wall 120 has at least one buckling point. In some embodiments, each wall 120 may include additional buckling points along its height as described in U.S. patent application Ser. No. 18/769,123, filed on Jul. 17, 2024, and titled "Cushions Including Buckling Columns with a Plurality of Buckling Points" ("the '123 application"), the entire disclosure of which is hereby incorporated herein. As depicted by FIGS. 4-5, the buckling layer may be configured similarly to the cushions of U.S. patent application Ser. No. 18/528,273, filed on Dec. 4, 2023, and titled "Elastomeric Cushioning Elements with Substantially Cylindrical Columns" ("the '273 application"), the entire disclosure of which is hereby incorporated herein. Alternatively, the buckling layer may be configured similar to any of the cushions of U.S. Pat. Nos. 5,749,111; 6,026,527; and 7,060,213.

The interconnected walls 120 may be formed from any suitable material. The material from which the interconnected walls 120 are made may include a compressible, resilient material. Some non-limiting examples of compressible, resilient materials that are suitable for forming the wall are disclosed by U.S. Pat. Nos. 5,994,450, 6,797,765, and 7,964,664, the entire disclosures of which are hereby incorporated herein by reference. The compressible, resilient material used to form the interconnected walls may include a thermoplastic elastomer (TPE). The thermoplastic elastomer may include a block copolymer (e.g., a triblock copolymer, such as an A-B-A triblock copolymer, etc.). The thermoplastic elastomer may be part of an elastomeric gel. The elastomeric gel may include a plasticizer-extended block copolymer. These plasticizer-extended block copolymers include plasticizer-extended A-B-A block copolymers, such as oil-extended styrene-[ethylene-(ethylene-propylene)]-styrene (SEEPS) block copolymers, oil-extended styrene-(ethylene-butylene)-styrene (SEBS) block copolymers, and other oil extended A-B-A block copolymers. Other copolymers are also considered, including A-B-C copolymers. Alternatively, the interconnected walls 120 may be formed from other materials, such as rubber (e.g., natural latex, polyurethane, butyl rubber, etc.), foam rubber (e.g., natural latex, polyurethane, viscoelastic foams, etc.), silicones, silicone copolymers, hydrogels, or any other suitable material.

As illustrated, an outer surface 124 of each buckling column 130 may be substantially smooth (e.g., free of voids or projections). A void 122 of the buckling column 130 is confined in an interior surface 126 of the buckling column 130. The interconnected walls 120 may be interconnected to one another and may define a buckling column 130 or voids 122 in an expanded form. As used herein, the term "expanded form" means and includes a state in which an elastomeric cushioning element has its original size and shape and the interconnected walls 120 are separated and define buckling columns 130.

Figure 6:
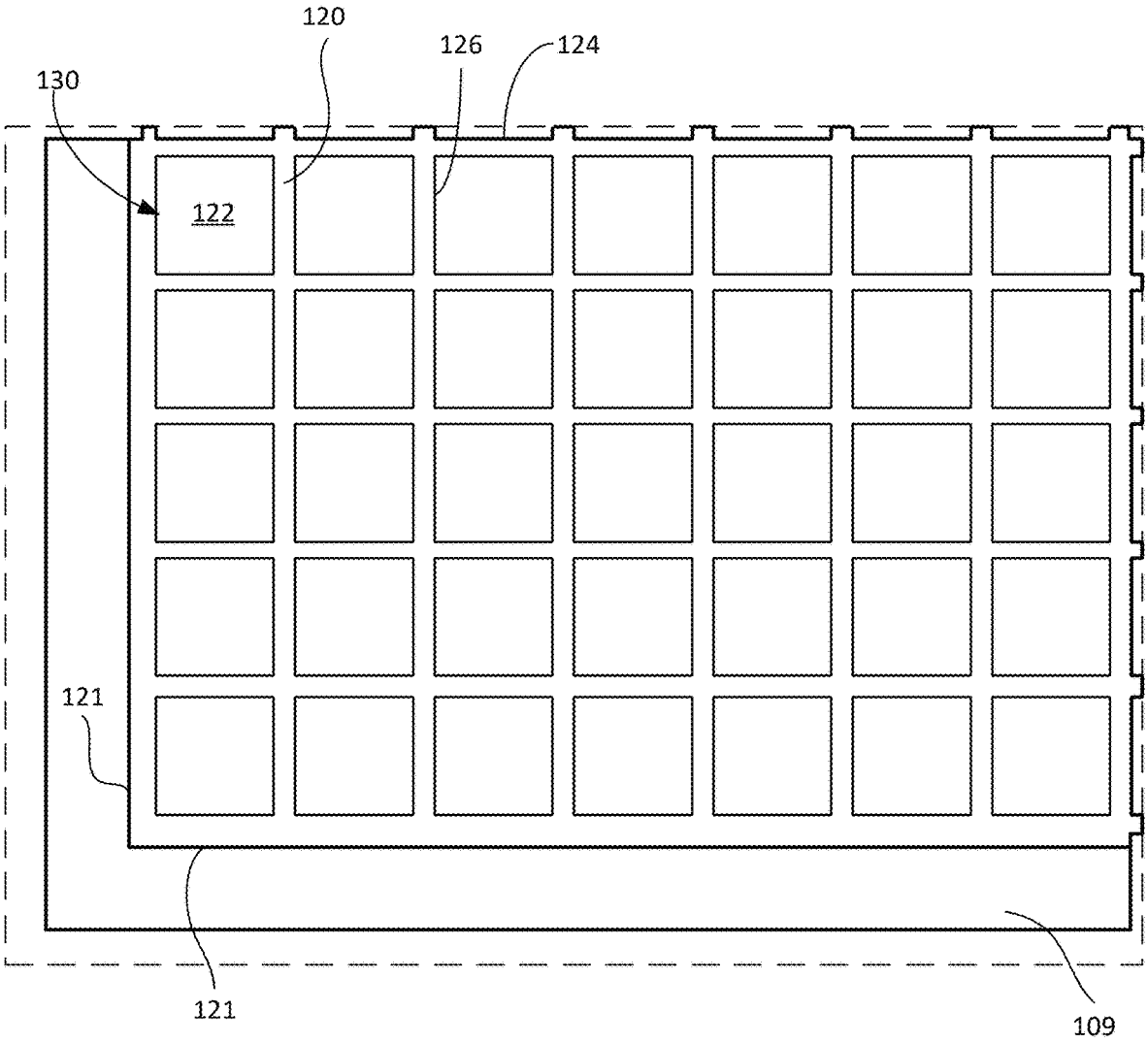
FIG. 6 is a top view of a portion of a buckling layer with interconnected walls that define rectangular buckling columns, according to an exemplary embodiment.

Referring now to FIG. 6, the interconnected walls 120 may extend in two directions, interconnected or intersecting at angles, such as right angles, and define square voids 122 and, thus, square buckling columns 130. However, in some embodiments, the interconnected walls 120 may be interconnected or intersect at other angles and define voids 122 and buckling columns 130 of other cross-sectional designs of any other polygonal (e.g. triangles, parallelograms, pentagons, hexagons, octagons, etc.) or circulator shape. For instance, one or more buckling layers may include buckling columns of a different cross-sectional designs from buckling columns in one or more other buckling layers.

The buckling layer may include additional structures and configurations, such as those structures and configurations described in, for example, U.S. Pat. No. 8,434,748, titled "Cushions Comprising Gel Springs," issued May 7, 2013; U.S. Pat. No. 8,628,067, titled "Cushions Comprising Core Structures and Related Methods," issued Jan. 14, 2014; U.S. Pat. No. 8,919,750, titled "Cushioning Elements Comprising Buckling Walls and Methods of Forming Such Cushioning Elements," issued Dec. 30, 2014; and U.S. Pat. No. 8,932,692, titled "Cushions Comprising Deformable Members and Related Methods," issued Jan. 13, 2015, the entire disclosure of each of which is hereby incorporated herein. Additionally, the interior surface 126 or the outer surface 124 may include additional structures (e.g. ledges as described in the '123 application; firmness-defining features as described in U.S. patent application Ser. No. 18/957,109, filed Nov. 22, 2024, and titled "Cushions with Columns Including Firmness-Defining Features," the entire disclosure of which is hereby incorporated herein; etc.).

Referring back to FIG. 6, a top view of a portion of a buckling layer, 108 or 110, with interconnected walls 120 that define buckling columns 130 is shown, according to an exemplary embodiment. In the embodiment of FIG. 6, the buckling columns 130 are rectangular and/or square. As shown, the interconnected walls 120 are aligned with the exterior walls 121, such that each side of a given buckling column 130 is either parallel or perpendicular to an exterior wall 121. In other embodiments, the buckling columns 130 may be arranged in a different orientation relative to the exterior walls 121. For example, the buckling columns may be rotated 45° relative to the exterior walls 121. Coupled to the exterior walls 121 is an edge portion (e.g., first edge portion 107, second edge portion 109). The buckling layer of FIG. 6 may otherwise be the same as the buckling layer of FIGS. 4-5. Additional information regarding the square buckling layer as shown in FIG. 6 is described in, or example U.S. Pat. No. 8,919,750, titled "Cushioning Elements Comprising Buckling Walls and Methods of Forming Such Cushioning Elements," issued Dec. 30, 2014, the entire disclosure of which is incorporated by reference herein.

In some embodiments, a single buckling layer of elastomeric cushioning element (i.e., first buckling layer 108) is disposed in the cushion assembly 100. In some embodiments, a plurality of buckling layers of elastomeric cushioning element (e.g., a first buckling layer 108 and a second buckling layer 110 or any number of buckling layers) may be disposed in the cushion assembly 100. In some embodiments, the plurality of bucking layers is arranged in a stack. In some embodiments, the first buckling layer 108 and second buckling layer 110 are substantially similar or identical in dimensions (e.g. thickness, width, diameter, etc.), arrangement (e.g., buckling column 130 shape, layer shape, number of buckling columns 130, etc.), or material (e.g.

elastomeric material, foam, etc.). In some embodiments, the first buckling layer 108 and second buckling layer 110 differ in dimensions, arrangement, or material. In some embodiments, a stabilization layer 111 (e.g., scrim, adhesive, etc.) may be disposed in between buckling layers to bond the adjacent bucking layers together. In some embodiments, the buckling layers are bonded in direct contact with each other (e.g., melting gels, bonded with adhesives, etc.). In some embodiments, the first buckling layer 108 is configured to have different mechanical properties (e.g., stiffness, dampening, deflection, elasticity, etc.) than the second buckling layer 110. In some embodiments, a first buckling layer 108 is configured to have dimensions, arrangement, material, or mechanical properties that vary laterally across the cushion assembly 100; the dimensions, arrangement, material, or mechanical properties mechanical properties may vary, by zone. Varying mechanical properties laterally across the cushion assembly 100 permit adapting different zones of cushioning effect for the preferences of more than one user. Additionally, different zones of the cushion assembly 100 may be adapted for the comfort of different body parts of a user (e.g., head, torso, feet, etc.)

Each buckling layer of the plurality of buckling layers (e.g., the first buckling layer 108, the second buckling layer 110, etc.) may include bucking columns which buckle under a different force, load, or weight. The force, or weight, required to buckle a buckling column depends on the dimensions, arrangement, material, and mechanical properties of the buckling layer. For example, a buckling layer having a height or thickness of 1 inch may buckle under a different force, or weight, than a buckling layer having a height or thickness of 2.0 inches (about 5.1 cm). Therefore, a cushion assembly 100 including a first buckling layer 108 of a first height or thickness and a second buckling layer 110 of a second height or thickness different than the first height or thickness of the first buckling layer 108, may buckle once for the first buckling layer 108 and buckle a second time for the second buckling layer 110. The separate buckling actions of stacked buckling layers allow for the cushion assembly 100 to compensate for a wide range of loading conditions in a single cushion assembly 100 while still providing comfort and support to a user.

Referring again to FIGS. 3-4, in some embodiments, one or more elastomeric cushioning elements configured in at least one or more layers may be disposed on top of the upper surface of the second intermediate layer 112. The at least one or more layers disposed on top include a microgrid layer 114. In some embodiments, the microgrid layer 114 is made of the same elastomer gel material as the first buckling layer 108 and/or the second buckling layer 110. However, it will be appreciated that the plasticizer to polymer ratios for the microgrid layer 114 may vary from the first buckling layer 108 and the second buckling layer 110 which may make the microgrid layer 114 "softer." In some embodiments, the microgrid layer 114 includes elastomeric cushioning elements made with a generally planar top and bottom surfaces. In other embodiments, the microgrid layer 114 may include at least one non-planar or substantially non-planar (e.g., non flat) top or bottom surface. The top and bottom surfaces refer to the vertically opposing substantially horizontally planar surfaces, not the vertical height or thicknesses, in FIG. 3 (only the top surface of the microgrid layer 114 is shown). In some embodiments, the microgrid layer 114 may include walls. The walls of the microgrid layer 114 may be interconnected to one another and may define an array of voids when the microgrid layer 114 is in an uncompressed form. As used herein, the term "uncompressed form" means and includes a state in which the microgrid layer 114 has its original size and shape and wherein the walls are separated and define voids. Each void and the walls that define it may together define a hollow column. In some embodiments, the voids are defined by a three-dimensional shape (e.g., tetrahedron, rectangular prism, etc.). In some embodiments, the walls of the microgrid layer 114 form two-dimensional shapes (e.g., triangular, diamond, rhombus, hexagon, etc.) hollow columns. In some embodiments, the microgrid layer 114 is one inch thick. In some embodiments, the microgrid layer 114 has thickness between approximately 0.25-2.0 inches (about 0.64-5.1 cm). The geometry of the buckling columns may be as shown in FIGS. 4-7. As such, in some embodiments, the microgrid layer 114 has a buckling point, and buckles similar to the buckling layers 108, 110. Furthermore, it is contemplated that the microgrid layer 114 may be disposed directly over the buckling layer(s) 108, 110 without the second intermediate layer 112. Similarly, the microgrid layer may be disposed over a single buckling layer 108 without a second buckling layer 110 and even further it is contemplated that some embodiments may not include any intermediate layers 112, 106 and only the buckling layers 108, 110 with or without the microgrid layer 114.

Figure 7:
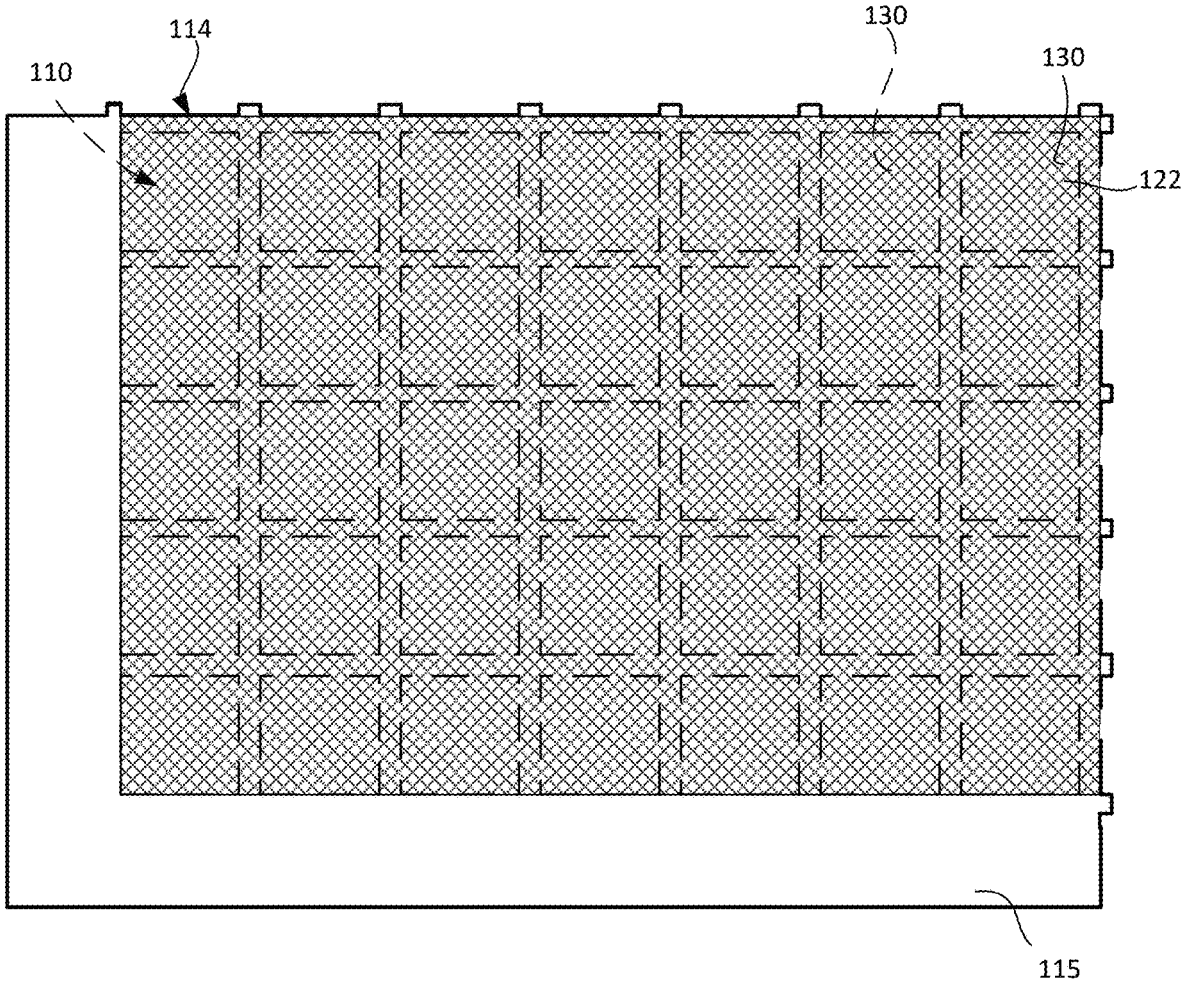
FIG. 7 is a top view illustrating the orientation of a microgrid layer relative to the buckling layer of FIG. 6, according to an exemplary embodiment.

Referring now to FIG. 7, a top view of the microgrid layer 114 is shown superimposed over buckling layer 110, according to an exemplary embodiment. In the illustration shown in FIG. 11, the intermediate layer 112 and any stabilization layers used for adhering the layers 110, 112, and 114 together have been removed to illustrate the orientation of the buckling columns 131 in the microgrid layer 114 relative to the orientation of the buckling columns 130 in the buckling layer 110. As shown, the microgrid layer 114 is offset at an angle from the buckling layer 110. In the example shown, the angle is approximately 45°. In other embodiments, the microgrid layer 114 may be offset between approximately 0° and 45° from the buckling layer 110. In still other embodiments, the angle may be a different angle (e.g., greater than 45°). Together and as shown, with the offset between the microgrid layer 114 and the buckling layer 110, the microgrid layer 114 and the buckling layer 110 may form a generally tetrahedral shape.

FIGS. 8-11 show side cross-sectional views of cushion assemblies, according to various exemplary different embodiments. As shown in FIGS. 8-11, in some embodiments, a cushion assembly 100 includes a coil layer 104, a first intermediate layer 106 disposed on top of the coil layer 104, one or more buckling layers disposed on top of the first intermediate layer 106, a second intermediate layer 112 disposed on top of the one or more buckling layers, and a microgrid layer 114 disposed on top of the second intermediate layer 112.

Each buckling layer is an elastomeric cushioning element with buckling columns 130 defining voids 122. Each buckling column has a buckling point-defined herein as a threshold pressure level after which the buckling column will buckle and the walls 120 collapse into the voids 122. Applicant has determined that use of different thicknesses or heights of layers of buckling columns or foam relative to other layers may provide enhanced support relative to traditional cushion assemblies. In some instances, the thickness of the first buckling layer 108 and/or the second buckling layer 110 may be between about 15.0% and about 20.0% of an overall thickness of the cushion assembly 100. In some embodiments, one or both first buckling layer 108 and the second buckling layer 110 may have a thickness of about 2.0 inches. In additional embodiments, one or both first buckling layer 108 and the second buckling layer 110 may have a thickness within a range of about 1.5 inches to about 2.5 inches. In further embodiments, one or both first buckling layer 108 and the second buckling layer 110 may have a thickness within a range of about 1 inch to about 2.0 inches. The embodiments shown in FIGS. 8-11 demonstrate cushion assemblies 800, 900, 1000, and 1100 with layers 104, 106, 108, 110, 112, and/or 114 of various thicknesses and arrangements. The different thicknesses and arrangements result in cushion assemblies 100 with different comfort properties, as explained in further detail below with reference to FIG. 12.

With reference still to FIGS. 8-11, the coil layer 104 and the first intermediate layer 106 comprise or form a base layer of the cushion assemblies 800-1100. In some embodiments and with reference to FIGS. 3 and 8-11, as shown the base layer includes a foam layer (i.e., the first intermediate layer 106) on top of a coil layer (e.g., the coil layer 104). In some embodiments, the foam layer may extend substantially across the coil layer. In other embodiments the foam layer is divided into a plurality of foam toppers positioned separately on top of individual coils in the coil layer, or with gel coil toppers, such as coils 105 with coils topper as disclosed in of U.S. Publication No. 2024/0251958. In some embodiments, the positions of the foam layer and the coil layer are reversed, with the coil layer 104 on top of the foam layer 106. Still in other embodiments, the first intermediate layer 106 is excluded, and the base layer includes the coil layer 104, while in other embodiments the coil layer 104 is excluded and the base layer includes the first intermediate layer 106. In other embodiments, the entire base layer, including the coil layer 104 and the first intermediate layer 106 is excluded. In such embodiments, the one or more buckling layers, the second intermediate layer 112, and the microgrid layer 114, may be positioned on another support or bottom layer such as a bed frame, a box spring, etc. Thus, it is to be appreciated that the structure and configuration of the base layer is variable in many embodiments.

As illustrated in FIG. 7, a microgrid layer 114 is an elastomeric cushioning element with buckling columns 130 defining diamond voids 122. Each buckling column has a buckling point characteristic (i.e., a threshold pressure after which the buckling column will buckle). In the example shown, each buckling column has a height or a thickness between 0.5-1 inch (about 1.3-2.5 cm) (e.g., ⅞ in). In some embodiments, the diamond voids of the microgrid are smaller than the square voids of a buckling layer. In some embodiments, from a top down view of the microgrid layer 114 on top a buckling layer such as the second buckling layer 110 shown in FIG. 7, the walls 120 of the microgrid layer 114 are not aligned with the walls 120 of the square voids 122 of a second buckling layer 110. In some embodiments, the walls 120 of the microgrid layer 114 are 45 degrees offset from the walls 120 of the second buckling layer to form a tetrahedral shape, as shown in FIG. 7. In some embodiments, a stabilization layer 111 (i.e., scrim) is disposed in between each layer to bond the layers together.

Figure 8:
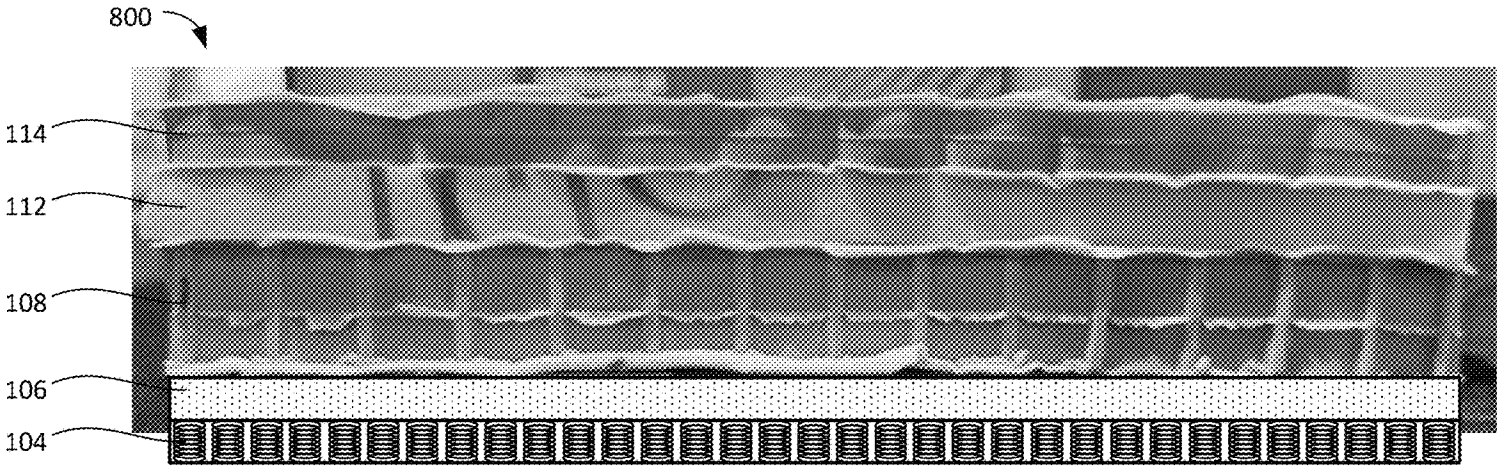
FIG. 8 is a side cross-sectional view of the cushion assembly of FIG. 1 configured as cushion assembly 800, according to another exemplary embodiment.

Referring specifically to FIG. 8, the cushion assembly 100 shown in a configuration as cushion assembly 800 is shown, according to an example embodiment. The cushion assembly 800 includes a coil layer 104. The coil layer 104 of the cushion assembly 800 may have a thickness or height of about 6.0 inches to about 9.0 inches. For example, the coil layer 104 of the cushion assembly 800 may have a thickness or height of about 7.5 inches. Moreover, in some embodiments, a bottom layer is included in the cushion assembly 800 disposed beneath the coil layer 104, and may have a thickness or height of about 0.50 inches to about 1.50 inches. As a non-limiting example, the bottom layer may have a thickness of about 1.00 inch. The bottom layer may be made of foam (e.g., viscoelastic, pneumatic, etc.) or an elastomeric gel as described herein. In some embodiments, the bottom layer may be a box frame.

On top of the coil layer 104 is a first intermediate layer 106. The first intermediate layer may be or include a viscoelastic foam (e.g., memory foam). In the example shown, the first intermediate layer 106 may have a first ILD value that is between firm and soft, such as a 22 ILD. The first intermediate layer 106 may have a first thickness or height. In some embodiments, the first thickness or height may be approximately 2.0 inches (about 5.1 cm). Moving vertically upward, on top of the first intermediate layer 106 is a first buckling layer 108. The first buckling layer 108 may have a thickness, such as approximately 2.0 inches (about 5.1 cm). The second intermediate layer 112 has second ILD value lower than the first ILD value of the first intermediate layer 106. For example, the second intermediate layer 112 may have an ILD less than 22 ILD, such as particularly 12 ILD. The second intermediate layer 112 may have a second thickness or height, which is approximately 1 inch. Continuing to move vertically upward (e.g., away from the coil layer 104), on top of the second intermediate layer 112 is a microgrid layer 114. The microgrid layer 114 is an elastomeric cushioning element with buckling columns 130 defining diamond voids 122. Each buckling column has a buckling point characteristic (i.e., a threshold pressure after which the buckling column will buckle). In the example shown, each buckling column has a height or a thickness between 0.5-1 inch (about 1.3-2.5 cm) (e.g., ⅞ in).

Figure 9:
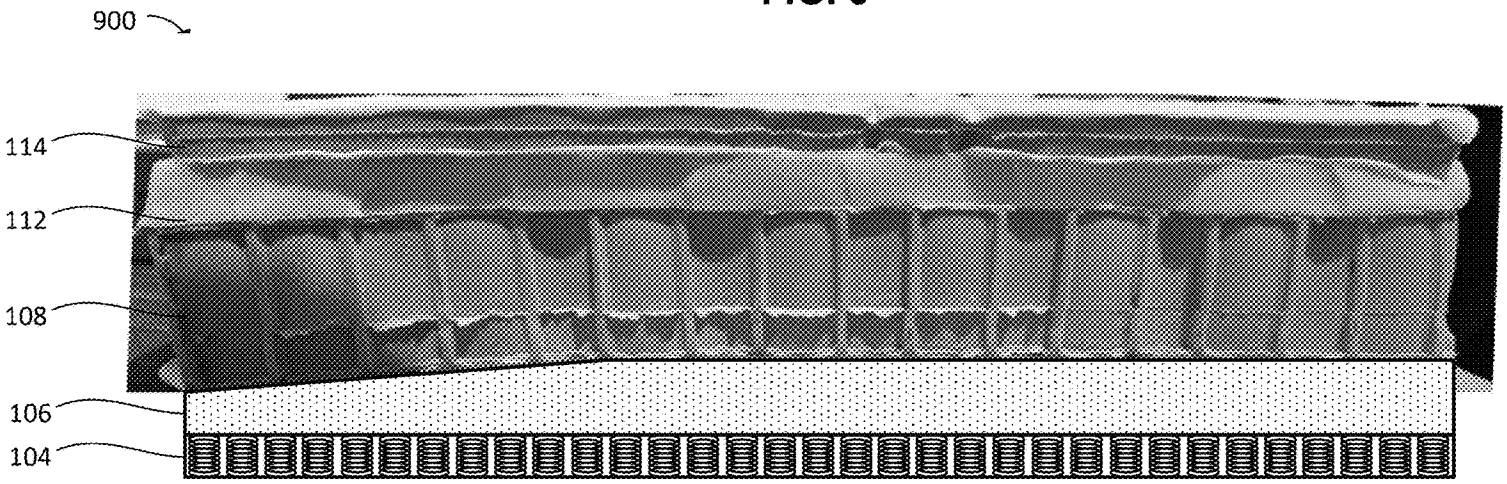
FIG. 9 is a side cross-sectional view of a cushion assembly of FIG. 1 configured as cushion assembly 900, according to still another exemplary embodiment.

Referring specifically to FIG. 9, the cushion assembly 100 shown in a configuration as cushion assembly 900 is shown, according to an example embodiment. The cushion assembly 900 includes a coil layer 104. The coil layer 104 of the cushion assembly 900 may have a thickness or height of about 6.0 inches to about 9.0 inches. For example, the coil layer 104 of the cushion assembly 900 may have a thickness or height of about 7.5 inches. Moreover, in some embodiments, a bottom layer is included in the cushion assembly 900 and may have a thickness or height of about 0.50 inches to about 1.50 inches. As a non-limiting example, the bottom layer may have a thickness of about 1.00 inch. The bottom layer may be made of foam (e.g., viscoelastic, pneumatic, etc.) or an elastomeric gel as described herein. In some embodiments, the bottom layer may be a box frame.

On top of the coil layer 104 is a first intermediate layer 106. The first intermediate layer may be or include a viscoelastic foam (e.g., memory foam). In the example shown, the first intermediate layer 106 may have a first ILD value that is between firm and soft, such as a 22 ILD. The first intermediate layer 106 may have a first thickness or height. In some embodiments, the first thickness or height may be approximately 2.0 inches (about 5.1 cm). Moving vertically upward, on top of the first intermediate layer 106 is a buckling layer 108. The buckling layer 108 may have a thickness, such as approximately 3 inches. The second intermediate layer 112 has second ILD value lower than the first ILD value of the first intermediate layer 106. For example, the second intermediate layer 112 may have an ILD less than 22 ILD, such as particularly 12 ILD. The second intermediate layer 112 may have a second thickness or height, which is approximately 1 inch. Continuing to move vertically upward (e.g., away from the coil layer 104), on top of the second intermediate layer 112 is a microgrid layer 114. The microgrid layer 114 is an elastomeric cushioning element with buckling columns 130 defining diamond voids 122. Each buckling column has a buckling point characteristic (i.e., a threshold pressure after which the buckling column will buckle). In the example shown, each buckling column has a height or a thickness between 0.5-1 inch (about 1.3-2.5 cm) (e.g., ⅞ in). The difference between the embodiments of FIGS. 8 and 9 is described in further detail below with reference to FIG. 12.

Figure 10:
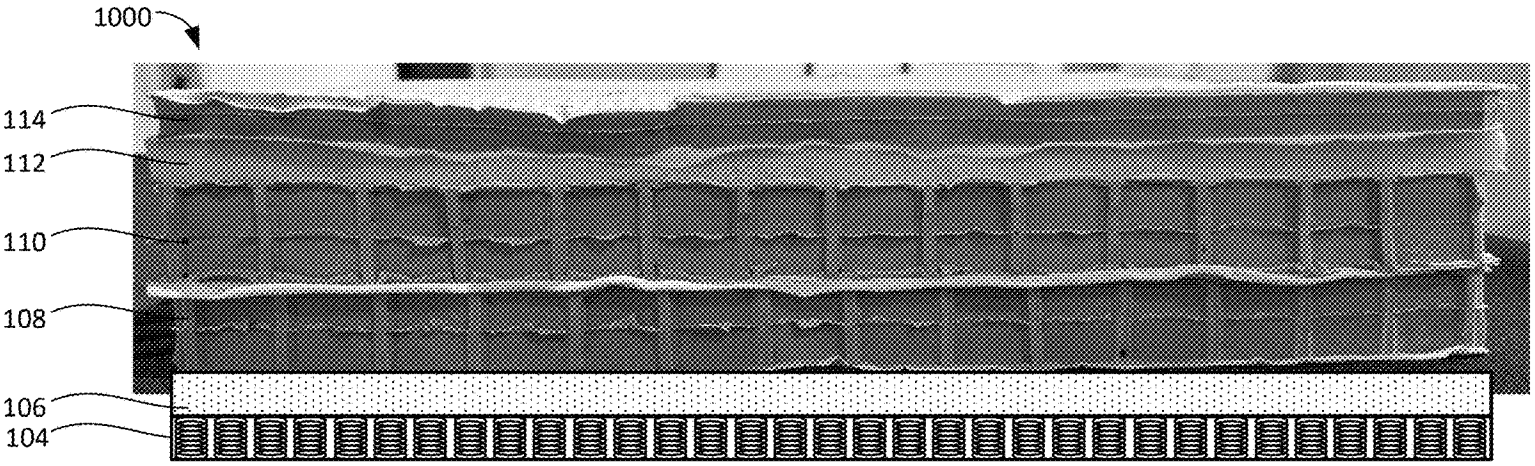
FIG. 10 is a side cross-sectional view of a cushion assembly of FIG. 1 configured as cushion assembly 1000, according to yet another exemplary embodiment.
Figure 11:
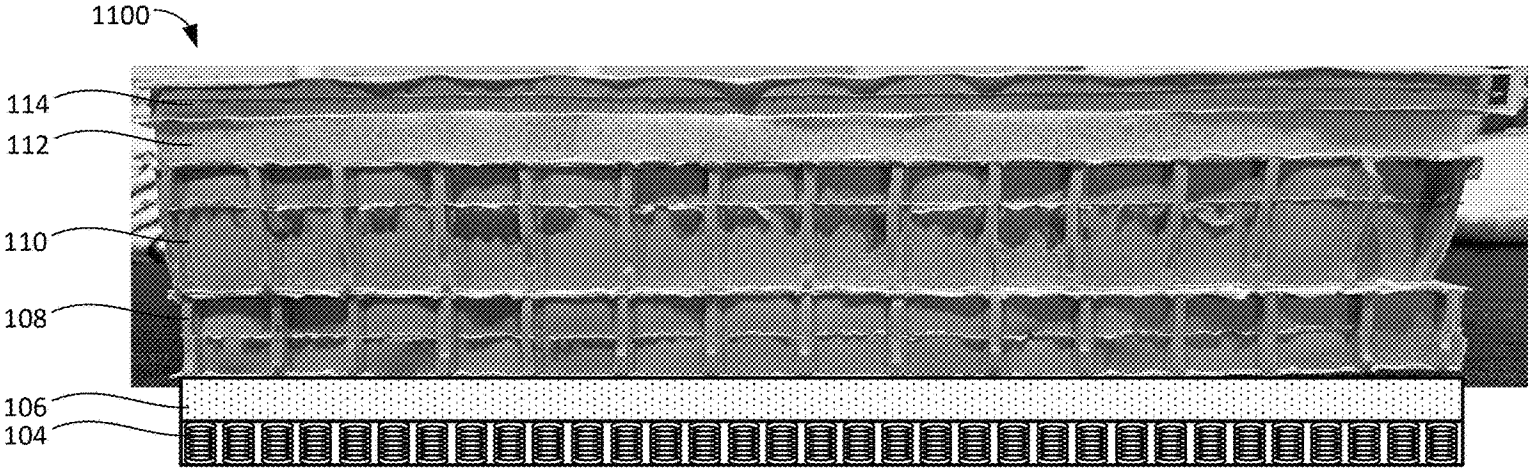
FIG. 11 is a side cross-sectional view of a cushion assembly of FIG. 1 configured as cushion assembly 1100, according to still yet another exemplary embodiment.

In some embodiments, the cushion assembly 100 includes multiple buckling layers superimposed on each other in a stacked configuration or arrangement. With reference to FIGS. 10-11, the multiple buckling layers is shown as a double buckling layer including a first buckling layer 108 and a second buckling layer 110 stacked on each other. In other embodiments, more than two buckling layers may be stacked on each other.

Referring specifically to FIG. 10, the cushion assembly 100 shown in a configuration as cushion assembly 1000 is shown, according to an example embodiment. The cushion assembly 1000 includes a coil layer 104. The coil layer 104 of the cushion assembly 800 may have a thickness or height of about 6.0 inches to about 9.0 inches. For example, the coil layer 104 of the cushion assembly 1000 may have a thickness or height of about 7.5 inches. Moreover, in some embodiments, a bottom layer is included in the cushion assembly 1000 and may have a thickness or height of about 0.50 inches to about 1.50 inches. As a non-limiting example, the bottom layer may have a thickness of about 1.00 inch. The bottom layer may be made of foam (e.g., viscoelastic, pneumatic, etc.) or an elastomeric gel as described herein. In some embodiments, the bottom layer may be a box frame.

On top of the coil layer 104 is a first intermediate layer 106. The first intermediate layer may be or include a viscoelastic foam (e.g., memory foam). In the example shown, the first intermediate layer 106 may have a first ILD value that is between firm and soft, such as a 22 ILD. The first intermediate layer 106 may have a first thickness or height. In some embodiments, the first thickness or height may be approximately 2.0 inches (about 5.1 cm). Moving vertically upward, on top of the first intermediate layer 106 is a first buckling layer 108. The first buckling layer 108 may have a thickness, such as approximately 2.0 inches (about 5.1 cm). Moving vertically upward, on top of the first buckling layer 108 is a second buckling layer 110. The second buckling layer 110 may have a thickness, such as approximately 2.0 inches (about 5.1 cm). Moving vertically upward, the second intermediate layer 112 has a second ILD value lower than the first ILD value of the first intermediate layer 106. For example, the second intermediate layer 112 may have an ILD less than 22 ILD, such as particularly 12 ILD. The second intermediate layer 112 may have a second thickness or height, which is approximately 1 inch. Continuing to move vertically upward (e.g., away from the coil layer 104), on top of the second intermediate layer 112 is a microgrid layer 114. The microgrid layer 114 is an elastomeric cushioning element with buckling columns 130 defining diamond voids 122. Each buckling column has a buckling point characteristic (i.e., a threshold pressure after which the buckling column will buckle). In the example shown, each buckling column has a height or a thickness between 0.5-1 inch (about 1.3-2.5 cm) (e.g., ⅞ in).

Referring specifically to FIG. 11, the cushion assembly 100 shown in a configuration as cushion assembly 1100 is shown, according to an example embodiment. The cushion assembly 1100 includes a coil layer 104. The coil layer 104 of the cushion assembly 800 may have a thickness or height of about 6.0 inches to about 9.0 inches. For example, the coil layer 104 of the cushion assembly 1100 may have a thickness or height of about 7.5 inches. Moreover, in some embodiments, a bottom layer is included in the cushion assembly 1100 and may have a thickness or height of about 0.50 inches to about 1.50 inches. As a non-limiting example, the bottom layer may have a thickness of about 1.00 inch. The bottom layer may be made of foam (e.g., viscoelastic, pneumatic, etc.) or an elastomeric gel as described herein. In some embodiments, the bottom layer may be a box frame.

On top of the coil layer 104 is a first intermediate layer 106. The first intermediate layer may be or include a viscoelastic foam (e.g., memory foam). In the example shown, the first intermediate layer 106 may have a first ILD value that is between firm and soft, such as a 22 ILD. The first intermediate layer 106 may have a first thickness or height. In some embodiments, the first thickness or height may be approximately 2.0 inches (about 5.1 cm). Moving vertically upward, on top of the first intermediate layer 106 is a first buckling layer 108. The first buckling layer 108 may have a thickness, such as approximately 2.0 inches (about 5.1 cm). Moving vertically upward, on top of the first buckling layer 108 is a second buckling layer 110. The second buckling layer 110 may have a thickness, such as approximately 3.0 inches (about 7.6 cm). Moving vertically upward, the second intermediate layer 112 has a second ILD value lower than the first ILD value of the first intermediate layer 106. For example, the second intermediate layer 112 may have an ILD less than 22 ILD, such as particularly 12 ILD. The second intermediate layer 112 may have a second thickness or height, which is approximately 1 inch. Continuing to move vertically upward (e.g., away from the coil layer 104), on top of the second intermediate layer 112 is a microgrid layer 114. The microgrid layer 114 is an elastomeric cushioning element with buckling columns 130 defining diamond voids 122. Each buckling column has a buckling point characteristic (i.e., a threshold pressure after which the buckling column will buckle). In the example shown, each buckling column has a height or a thickness between 0.5-1 inch (about 1.3-2.5 cm) (e.g., ⅞ in).

Therefore, in some embodiments, the cushion assembly 100 includes a plurality of buckling layers with a corresponding plurality of buckling points. Further, in some embodiments, a single buckling layer may have multiple buckling points. For example, a two-inch buckling layer may have a single buckling point while a three-inch buckling layer may have two buckling points. Each of the buckling points may be different, in that each requires a different threshold pressure (e.g., force, load, or weight) to buckle. A buckling point is a pressure threshold at which the buckling columns buckle, reducing the load the buckling column would carry in comparison to if the buckling column was restrained from buckling. When a column buckles, the walls of the buckling column deform and extend into the void that defines the buckling column, decreasing the distance between the upper and lower planar surfaces of the buckling column. The plurality of buckling layers may have a plurality of buckling points such that each layer of the plurality of buckling layers buckles at a different threshold pressure. Therefore, one layer may buckle at a first lower pressure, while a second layer will remain unbuckled until the pressure is increased to a second greater pressure, which is sufficient to also buckle the second layer as well. The plurality of different buckling points allows the cushion assembly 100 to have different comfort and support characteristics that are dependent on the force, load, or weight applied to the cushion assembly 100. When the buckling layers are stacked, the plurality of different buckling points thereby allows the cushion assembly 100 to accommodate a wide variety of loading conditions without the need to change the configuration of the cushion assembly 100. For example, users of differing weights will apply different loading conditions from another (e.g., a 200 lb. person and a 150 lb. person). A 150 lb. person may only be capable of applying a sufficient pressure to exceed a buckling point (e.g., a first pressure threshold) of a first buckling layer. Therefore, the first buckling layer will buckle, but the second buckling layer will not. This may provide the 150 lb. person with both comfort and support. However, the 200 lb. person may feel inadequately comforted by the buckling of only the single buckling layer as the depth of compression may be inadequate. Beneficially, the stacked arrangement of buckling layers with a plurality of buckling points may mean, for example, the 200 lb. person applies a sufficient pressure to exceed the buckling point (e.g., a first pressure threshold) of the first buckling layer and the buckling point (e.g., a second, greater pressure threshold) of the second buckling layer. Therefore, the first buckling layer and the second buckling layer will buckle for the 200 lb. person, providing an increased comfort characteristic due to the increased depth of compression. The same dual stage buckling may apply to a user during different loading conditions, as in when lying on their back the pressure may only be sufficient to buckle the first layer, versus lying on their side the pressure may be sufficient to buckle both the first and second layer.

In some embodiments, the physical properties of the cushion assembly 100 vary laterally across the top surface of the cushion assembly 100. In such embodiments, physical properties of the cushion assembly 100 may be varied by changing the mechanical properties (e.g., stiffness, dampening, deflection, elasticity, etc.) of the elastomer gel, the geometry of the buckling columns 130, or the materials of the cushion assembly 100 components (e.g., the buckling layers, microgrid layers 114, etc.). For instance, while circular and rectangular cross-sectional designs of the geometry of the buckling columns is showcased it will be appreciated that alternate geometries are contemplated including any polygonal (e.g. hexagon, pentagon, octagon, triangle, etc.) or circular shape, and more than one such geometry of buckling column may be included in a single cushion assembly 100, including within a single layer of a cushion assembly 100. In some embodiments, the cushion assembly 100 can include more than two zones of mechanical properties by disposing more than two zones of the buckling layers or the microgrid layer 114. Varying physical properties laterally across the cushion assembly 100 allows the cushion assembly 100 to provide a different cushioning effect in each zone. The different zones of the cushion assembly 100 may be adapted for different body parts of a user (e.g., head, torso, feet, etc.). For example, a user may prefer a stiffer cushion at their head than the cushion at their feet. The cushioning assembly 100 may include a first at the head end of the cushion assembly 100 which may be stiffer than a second zone of the cushioning assembly 100 at the foot end of the cushion assembly 100.

Figure 12:
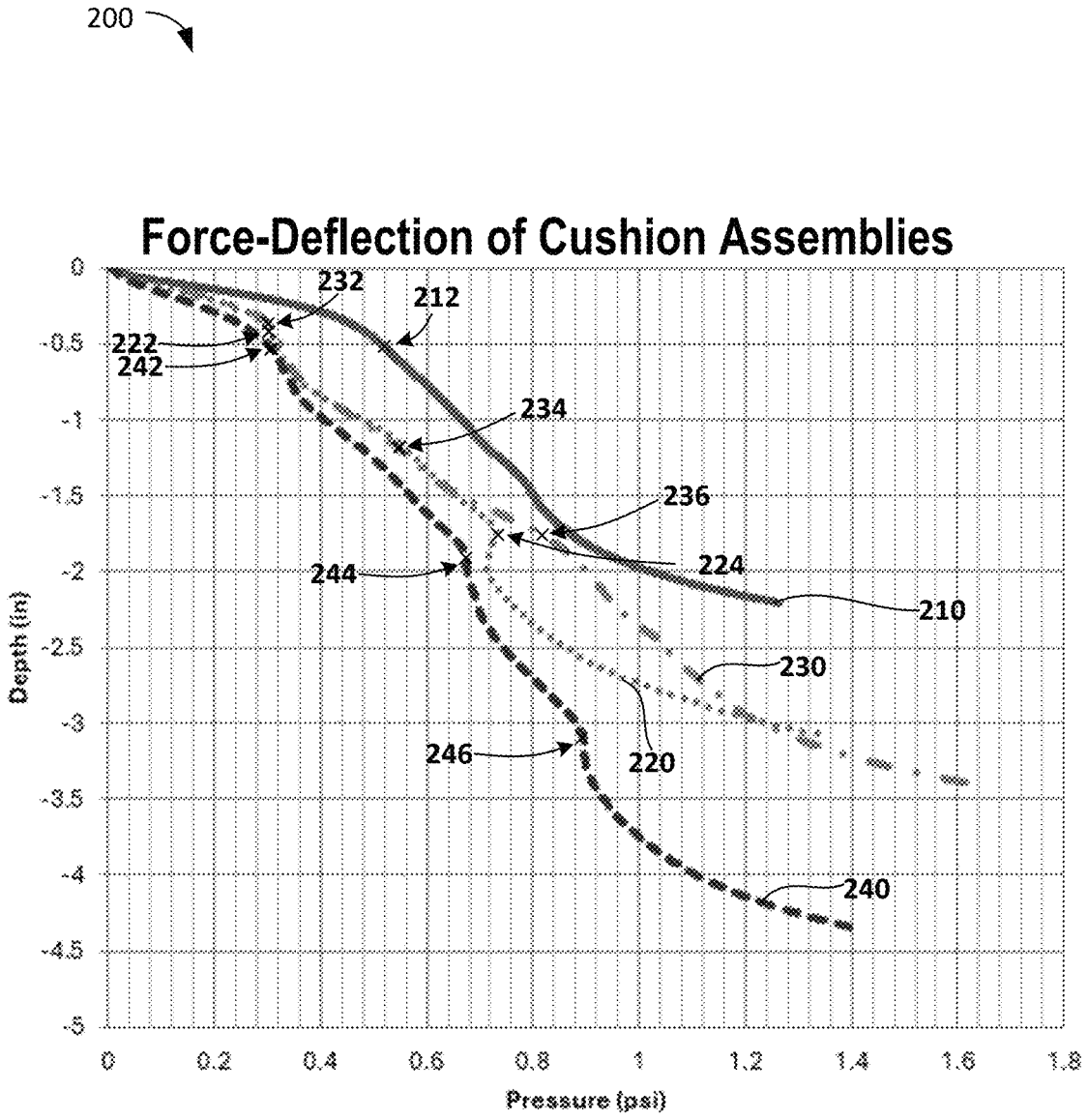
FIG. 12 is a graph of force-deflection measurements of various cushion assemblies, according to an exemplary embodiment.

Referring to FIG. 12, a graph 200 of force-deflection measurements of cushion assemblies according to the exemplary embodiments of FIGS. 8-11 is shown, according to an example embodiment. At the x-axis, a force, or pressure, applied to a cushion assembly 100 is measured in pounds-per-square inch ("PSI") and, at the y-axis, a deflection, or depth of compression, of the cushion assembly 100 is measured in inches. The graph 200 displays the depth of compression of a cushion assembly 100 as pressure is applied. Inflection points (or changes in the slope or rate of change) indicate a change in the layer or component of a cushion assembly 100 that is deforming. Inflection points may indicate a buckling of a buckling layer (e.g., 108, 110, etc.) or microgrid layer 114 or a complete compression of a foam layer (e.g., first intermediate layer 106, second intermediate layer 112, etc.). A buckling point is a pressure threshold at which the buckling columns buckle, reducing the load the buckling column would carry in comparison to if the buckling column was restrained from buckling. The buckling point corresponds to the amount of force that causes the walls of the buckling column to deform and extend into the void that defines the buckling column, decreasing the distance between the upper and lower surfaces of the buckling column. Complete compression is a pressure threshold at which the foam layer cannot carry additional load. Complete compression corresponds to the amount of force that decreases the upper and lower surfaces of the foam layer to a minimal distance from each other, resulting in a change in the depth of compression of the cushion assembly 100. In some embodiments, the change in depth for each unit of applied pressure (e.g., the slope of a line of graph 200) is substantially constant until an inflection point. At the inflection point, the magnitude of the slope of the line increases. This indicates that the cushion assembly is deforming a greater amount for each unit of applied pressure. In other words, at the inflection point, the cushion assembly feels softer as it is more easily as compared to the cushion assembly prior to the inflection point. The inflection point thus indicates a change in the response of a cushion assembly, from a firmer cushion with less deformation per unit of pressure (a slope of a first magnitude) to a softer cushion with greater deformation per unit of pressure (a slope of a second magnitude greater than the first). The increase in pressure therefore changes the slop from a smaller slope x to a larger slope of x+y. A larger slope represents more depth and deformation for a unit of applied pressure than a lesser slope.

Graph 200 shows four measurements 210, 220, 230, and 240 of the cushion assemblies of FIGS. 8, 9, 10, and 11, respectively. The measurements 210, 220, 230, and 240 illustrate the buckling stages and non-buckling stages of each of the cushion assemblies of FIGS. 8-11. Each measurement 210-240 illustrates at least one buckling point for each of the cushion assemblies 800, 900, 1000, and 1100. It should be understood that the cushion assemblies 800-1100 may have more or fewer buckling points than represented in the experimental test results shown in measurements 210-240. For example, under some loading conditions, the microgrid layer 114 may fold laterally, rather than buckle, resulting in a more gradual deformation. Similarly, under some loading conditions, while not common a single buckling column (e.g., buckling column 130) may have more than one buckling point. Thus, it should be understood the measurements 210-240 of graph 200 are representative only and illustrate the behavior of the cushion assemblies 800-1100 under specific testing conditions. However, the number of buckling points and the pressures at which the buckling points occur may vary under different loading conditions.

Measurement 210 corresponds to experimental data of cushion assembly 800 of FIG. 8 with a single two-inch buckling layer (i.e., first buckling layer 108) and the microgrid buckling layer 114. Describing measurement 210, the magnitude of the slope is substantially constant until a first inflection point 212, which represents the buckling of the first buckling layer 108. After the first inflection point 212, the magnitude of the slope increases until the column finishes buckling, at which point the magnitude of the slope decreases. As described above, in some embodiments the microgrid layer 114 also buckles under compression. In cushion assembly 800 the microgrid layer has an unbuckled height or a thickness between 0.5-1 inch (about 1.3-2.5 cm) (e.g., ⅞ in), such that buckling the buckling point of the microgrid layer 114 may in some instances result in a more gradual change in deformation than the thicker first buckling layer 108. Therefore, it should be understood the reference to the first inflection point 212 does not imply that in all circumstances the cushion assembly 800 has a single inflection point. Rather, as described herein the measurements 210 are representative only, and in some embodiments the first buckling layer 108 and the microgrid layer 114 of the cushion assembly 800 buckle under compression between 0 and 1.8 psi.

Measurement 220 corresponds to experimental data of cushion assembly 900 of FIG. 9 with a single three-inch buckling layer (i.e., first buckling layer 108) and the microgrid buckling layer 114. Describing measurement 220, the magnitude of the slope is substantially constant until a first inflection point 222, which represents the buckling of the microgrid layer 114. At the first inflection point 222, the magnitude of the slope increases until the buckling column 130 of the microgrid layer 114 is finishes buckling, at which point the magnitude of the slope decreases. Measurement 220 also includes the second inflection point 224, which represents the buckling of the first buckling layer 108 of the cushion assembly 900. At the second buckling point 224, the magnitude of the slope increases until the column is finishes buckling, at which point the magnitude of the slope decreases.

Measurement 230 corresponds to experimental data of cushion assembly 1000 of FIG. 10 with two two-inch buckling layers (i.e., first buckling layer 108 and second buckling layer 110)) and the microgrid buckling layer 114. Describing measurement 230, the magnitude of the slope is substantially constant until a first inflection point 232, which represents the buckling of the microgrid layer 114. At the first inflection point 232, the magnitude of the slope increases until the column is finishes buckling. The second inflection point 234 represents one of the two buckling layers (i.e., first buckling layer 108 or second buckling layer 110), buckling. At the second inflection point 234, the magnitude of slope increases again until the column is finishes buckling, at which point the magnitude of the slope decreases. The third inflection point 236 represents the other of the two buckling layers (i.e., first buckling layer 108 or second buckling layer 110) buckling. At the third inflection point 236, the magnitude of the slope increases until the column finishes buckling, at which point the magnitude of the slope decreases.

Measurement 240 corresponds to experimental data of cushion assembly 1100 of FIG. 11 with an upper three-inch buckling layer (i.e., second buckling layer 110), a lower two-inch buckling layer (i.e., first buckling layer 108), and the microgrid layer 114. Describing measurement 240, the magnitude of the slope is substantially constant until a first inflection point 242, which represents the buckling of the microgrid layer 114. At the first inflection point 242, the magnitude of the slope increases until the column is finishes buckling, at which point the magnitude of the slope decreases. The second inflection point 244 represents one of the buckling layers (i.e., the first buckling layer 108 or the second buckling layer 110) buckling. At the second inflection point 244, the magnitude of the slope increases until the column is finishes buckling, at which point the magnitude of the slope decreases. The third inflection point 246 represents the other of the two buckling layers (i.e., the first buckling layer 108 or the second buckling layer 110) buckling. At the third inflection point 246 the magnitude of the slope increases until the column is buckled, at which point the magnitude of the slope decreases.

Comparing the experience of a user lying on the cushion assemblies represented by the illustrated measurements, a user lying on the cushion assembly 800 of measurement 210 would experience less deformation and firmer mattress with less cushioning. A user lying on the cushion assembly 900 of measurement 220 would experience more deformation with a change in deformation at a first pressure threshold (e.g., first inflection point 222) and at a second pressure threshold (e.g., second inflection point 224). A user lying on cushion assembly 1000 of measurement 230 would experience a smoother deformation than cushion assemblies 800 or 900 and would ultimately sink further into the cushion assembly 1000. A user lying on cushion assembly 1100 would experience more deformation with three distinct abrupt changes in deformation (e.g., buckling points) and a greater total deformation of the cushion assembly 1100.

The experimental results shown in FIG. 12 illustrate the buckling of the various layers of the cushion assemblies of FIGS. 8, 9, 10, and 11, but it will be appreciated that a cushion assembly 100 of alternate configurations and designs may have a different comfort experience with a different number of buckling points and/or buckling points at different depths and/or pressures.

Figure 13:
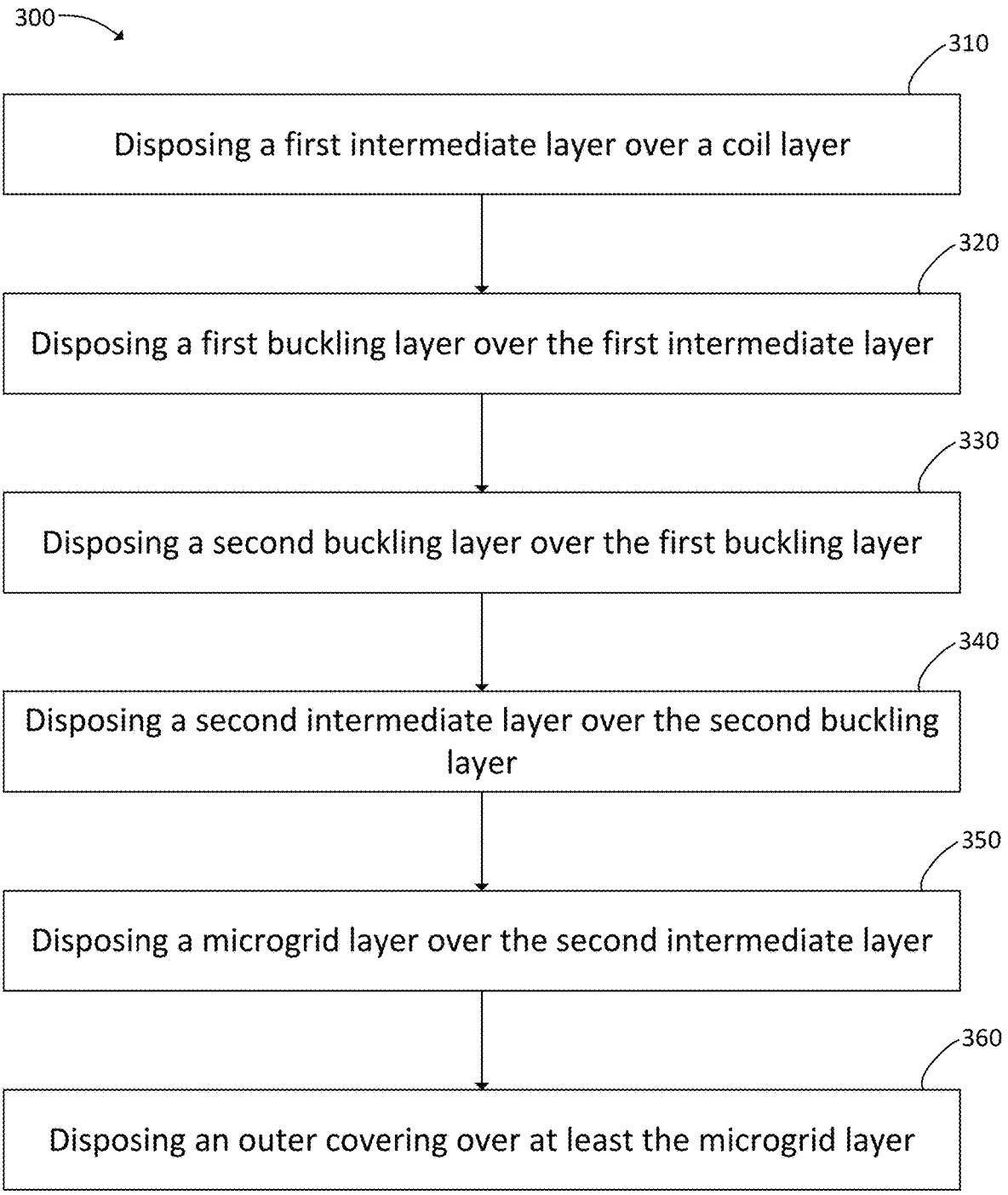
FIG. 13 is flow diagram of a process for manufacturing a cushion assembly, according to an exemplary embodiment.

Referring to FIG. 13, a flow diagram of a process 300 of manufacturing the cushion assembly 100 or a portion thereof, according to an exemplary embodiment. In assembling the cushion assembly 100, the layers are stacked or disposed over an upper surface of each other, wherein the upper surface corresponds to the surface of the layer closer to the surface that the user will lay on. Process 300 includes step 310 of disposing a first intermediate layer 106 over an upper surface of a coil layer 104. The first intermediate layer 106 may be located over and at least partially extended over an upper surface of coil layer 104. The first intermediate layer 106 may or may not be adhered (e.g., sewn, glued, scrimmed, welded, etc.) to the coil layer 104. In some embodiments, the first intermediate layer 106 is fixed to the coil layer 104. In some embodiments, the first intermediate layer 106 is placed over the coil layer 104 but able to translate laterally relative to the coil layer 104. Gluing contemplated may be water-based glues commonly used in applications such as this as well as hot-melt and the like.

Step 320 includes disposing a first buckling layer 108 over an upper surface of the first intermediate layer 106. The first buckling layer 108 may be located over and at least partially extended over an upper surface the first intermediate layer 106. The first buckling layer 108 may or may not be attached or adhered (e.g., sewn, glued, scrimmed, welded, etc.) to the first intermediate layer 106. In some embodiments, the first buckling layer 108 is fixed to the first intermediate layer 106. In some embodiments, the first buckling layer 108 is placed over the first intermediate layer 106 but able to translate laterally relative to the first intermediate layer 106.

Step 330 includes disposing a second buckling layer 110 over an upper surface of the first buckling layer 108. The second buckling layer 110 may be located over and at least partially extended over an upper surface of first buckling layer 108. The second buckling layer 110 may or may not be adhered (e.g., sewn, glued, scrimmed, welded, etc.) to the first buckling layer 108. In some embodiments, the second buckling layer 110 is fixed to the first buckling layer 108 via a stabilization material. In some embodiments, the second buckling layer 110 is placed over the first buckling layer 108 but able to translate laterally relative to the first buckling layer 108.

Step 340 includes disposing a second intermediate layer 112 over an upper surface of the second buckling layer 110. The second intermediate layer 112 may be located over and at least partially extended over an upper surface of second buckling layer 110. The second intermediate layer 112 may or may not adhered (e.g., sewn, glued, scrimmed, welded, etc.) to the second buckling layer 110. In some embodiments, the second intermediate layer 112 is fixed to the second buckling layer 110 by a stabilization material. In some embodiments, the second intermediate layer 112 is placed over the second buckling layer 110 but able to translate laterally relative to the second buckling layer 110.

Step 350 includes disposing a microgrid layer 114 over an upper surface of the second intermediate layer 112. The microgrid layer 114 may be located over and at least partially extended over an upper surface of second intermediate layer 112. The microgrid layer 114 may or may not be attached or adhered (e.g., sewn, glued, scrimmed, welded, etc.) to the second intermediate layer 112. In some embodiments, the microgrid layer 114 is fixed to the second intermediate layer 112 by a stabilization material. In some embodiments, the microgrid layer 114 is placed over the second intermediate layer 112 but able to translate laterally relative to the second intermediate layer 112.

Step 360 include disposing an outer covering 116 over at least the microgrid layer 114. In some embodiments, the outer covering 116 is disposed over all the other components of the cushion assembly 100. In some embodiments, additional buckling layers are disposed or stacked over the second buckling layer 110; in such embodiments, the second intermediate layer 112 is disposed over the upper surface of the topmost buckling layer. Between each of the layers of the cushion assembly 100 (e.g., the coil layer 104, the first intermediate layer 106, the first buckling layer 108, the second buckling layer 110, the second intermediate layer 112 and/or the microgrid layer 114) there may be provided a stabilization layer 111 as described herein.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled" as used herein means the joining of two members directly or indirectly to one another. Such joining may be stationary (e.g., permanent) or moveable (e.g., removable or releasable). Such joining may be achieved with the two members, or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A,' only 'B,' as well as both 'A' and 'B.' Such references used in conjunction with "comprising" or other open terminology can include additional items.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the assembly as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes, and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed:

1. A cushion assembly, comprising;

a first intermediate layer;

a first buckling layer having a first plurality of interconnected walls defining a first plurality of voids;

a second buckling layer disposed over an upper surface of the first buckling layer such that the first and second buckling layers are arranged in a stacked arrangement, the second buckling layer having a second plurality of interconnected walls defining a second plurality of voids;

a second intermediate layer disposed over an upper surface of the second buckling layer; and a microgrid layer comprising substantially planar top and bottom surfaces that is disposed over and vertically above an upper surface of the second intermediate layer, the microgrid layer having a third plurality of interconnected walls defining a third plurality of voids, the third plurality of interconnected walls being offset at an angle from the second plurality of interconnected walls, and the third plurality of voids being smaller in thickness and width than the second plurality of voids.

2. The cushion assembly of claim 1, wherein the microgrid layer comprises a first zone with a first mechanical property and second zone with a second mechanical property.

3. The cushion assembly of claim 1, wherein the first buckling layer comprises a first elastomeric cushioning element with a first buckling point.

4. The cushion assembly of claim 3, wherein the second buckling layer comprises a second elastomeric cushioning element with a second buckling point, different from the first buckling point.

5. The cushion assembly of claim 4, wherein the microgrid layer is configured with a third buckling point.

6. The cushion assembly of claim 1, wherein the first intermediate layer comprises a first foam having a first indentation load deflection value.

7. The cushion assembly of claim 6, wherein the second intermediate layer comprises a second foam having a second indentation load deflection value, wherein the second indentation load deflection value is lower than the first indentation load deflection value such that the second intermediate layer is relatively softer than the first intermediate layer.

8. The cushion assembly of claim 1, wherein the first buckling layer has a buckling point different than the second buckling layer.

9. A cushion assembly, comprising:

a coil layer comprising a plurality of coils;

a first intermediate layer disposed over an upper surface of the coil layer;

a first buckling layer positioned above the first intermediate layer and having a first plurality of interconnected walls defining a first plurality of voids;

a second buckling layer disposed over an upper surface of the first buckling layer such that the first and second buckling layers are arranged in a stacked arrangement, the second buckling layer having a second plurality of interconnected walls defining a second plurality of voids;

a second intermediate layer disposed over an upper surface of the second buckling layer; and a microgrid layer comprising substantially planar top and bottom surfaces that is disposed over and vertically above an upper surface of the second intermediate layer, the microgrid layer having a third plurality of interconnected walls defining a third plurality of voids, the third plurality of interconnected walls being offset at an angle from the second plurality of interconnected walls, and the third plurality of voids being smaller in thickness and width than the second plurality of voids.

10. The cushion assembly of claim 9, wherein the first buckling layer comprises a first elastomeric cushioning element having a first buckling point.

11. The cushion assembly of claim 10, wherein the second buckling layer comprises a second elastomeric cushioning element with a second buckling point.

12. The cushion assembly of claim 10, wherein the third plurality of interconnected walls are formed from a gel material.

13. The cushion assembly of claim 9, wherein the first intermediate layer comprises a first foam having a first indentatation load deflection value.

14. The cushion assembly of claim 13, wherein the second intermediate layer comprises a second foam having a second indentation load deflection value, wherein the second indentation load deflection value is lower than the first indentation load deflection value.

15. The cushion assembly of claim 9, wherein the microgrid layer comprises a first zone with a first mechanical property and second zone with a second mechanical property.

16. A cushion assembly, comprising:

a coil layer comprising a plurality of coils;

a first intermediate foam layer disposed over an upper surface of the coil layer;

a plurality of buckling elastomeric layers, arranged in a stack, comprising:

a first buckling elastomeric layer having a first plurality of interconnected walls defining a first plurality of voids, a second buckling elastomeric layer disposed over an upper surface of the first buckling elastomeric layer, the second buckling elastomeric layer having a second plurality of interconnected walls defining a second plurality of voids, and at least one scrim layer configured with a surface to adhere the first buckling elastomeric layer to the second buckling elastomeric layer;

a second intermediate foam layer disposed over an upper surface of the second buckling elastomeric layer of the plurality of buckling elastomeric layers; and a microgrid gel layer comprising substantially planar top and bottom surfaces that is disposed over and vertically above an upper surface of the second intermediate foam layer, the microgrid gel layer having a third plurality of interconnected walls defining a third plurality of voids, the third plurality of interconnected walls being offset at an angle from the second plurality of interconnected walls, and the third plurality of voids being smaller in thickness and width than the second plurality of voids, wherein the plurality of buckling elastomeric layers is disposed over an upper surface of the first intermediate foam layer.

17. The cushion assembly of claim 16, wherein the first buckling elastomeric layer is configured with a first buckling point and the second buckling elastomeric layer is configured with a second buckling point.

18. The cushion assembly of claim 17, wherein the microgrid gel layer is configured with a third buckling point.

19. The cushion assembly of claim 16, wherein the first intermediate foam layer comprises a first foam having a first indentation load deflection value.

20. The cushion assembly of claim 19, wherein the second intermediate foam layer comprises a second foam having a second indentation load deflection value, wherein the second indentation load deflection value is lower than the first indentation load deflection value.

* * * * *